United States Patent [19]

Bando et al.

[11] Patent Number: 4,661,765

[45] Date of Patent: Apr. 28, 1987

[54] ALTERNATING CURRENT LOAD POWER CONTROLLER

[75] Inventors: Toshiro Bando; Kiyoto Kozaiku, both of Yokohama, Japan

[73] Assignee: Ricoh Company, Ltd., Tokyo, Japan

[21] Appl. No.: 735,433

[22] Filed: May 17, 1985

[30] Foreign Application Priority Data

Jun. 18, 1984 [JP] Japan ..... 59-124929

[51] Int. Cl.[4] ..... G05F 1/10

[52] U.S. Cl. ..... 323/241; 323/322

[58] Field of Search ..... 323/235, 241, 322, 323; 364/483

[56] References Cited

U.S. PATENT DOCUMENTS

| | | | |
|---|---|---|---|
| 4,371,943 | 2/1983 | Woods et al. | 364/483 X |
| 4,374,321 | 2/1983 | Cunningham, Jr. et al. | 323/235 X |
| 4,435,677 | 3/1984 | Thomas | 323/235 |
| 4,506,146 | 3/1985 | Rice et al. | 323/235 X |
| 4,538,231 | 8/1985 | Abe et al. | 323/323 X |

FOREIGN PATENT DOCUMENTS

| | | |
|---|---|---|
| 58-29393 | 2/1983 | Japan . |
| 58-79496 | 5/1983 | Japan . |
| 2105931 | 3/1983 | United Kingdom . |

*Primary Examiner*—Patrick R. Salce
*Assistant Examiner*—Marc S. Hoff
*Attorney, Agent, or Firm*—Mason, Fenwick & Lawrence

[57] ABSTRACT

Alternating current electric power fed to a load is controlled to a target value using phase control. During a half cycle of the alternating current waveform, sampling of voltage and square calculation of the sampled value are repeated. During the remaining half cycle, average value calculation based on the result of the above calculation, root calculation and proportional calculation are implemented. Thus, the power control cycle is completed within one cycle of the alternating current waveform. By utilizing a plurality of sampling data, dropped data locating in a non-sampling period therebetween is obtained by interpolation. Sampling starts in synchronism with the energizing start-up phase.

9 Claims, 53 Drawing Figures

| DISIN | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| DISP DATA | SET RMS | ST VOLT | RMS | VOLT | PHA NGL | PH TIM | EXP CNT | SET FUS | STF DEG | FU TEMP | FU DEG | FU CYC | DR TEMP | DR DEG | DR CYC | HR CNT |

Fig. 3e

| | | | | |
|---|---|---|---|---|
| 0–7 | | BANK 0 WORKING REGISTER | | |
| 8–23 | | 8-LEVEL STACK | | |
| 24–31 | | BANK 1 WORKING REGISTER | | |
| 32 | SETRMS | SET EFFECTIVE VALUE OF LAMP VOLTAGE | SEL.SW. 0 | DISPLAY BUFFER |
| 33 | STVOLT | SET LAMP VOLTAGE IN VOLTS | 1 | |
| 34 | RMS | EFFECTIVE VALUE OF SAMPLED LAMP VOLTAGE | 2 | |
| 35 | VOLT | LAMP VOLTAGE IN VOLTS | 3 | |
| 36 | PHANGL | PHASE ANGLE OF LAMP VOLTAGE | 4 | |
| 37 | PHTiM | PHASE ANGLE OF IN msec | 5 | |
| 38 | EXPCNT | EXPOSURE COUNTER | 6 | |
| 39 | SETFUS | FUSING TEMPERATURE SETTING VALUE | 7 | |
| 40 | STFDEG | FUSING TEMPERATURE SETTING VALUE IN °C | 8 | |
| 41 | FUTEMP | FUSING TEMPERATURE | 9 | |
| 42 | FUDEG | FUSING TEMPERATURE IN °C | A | |
| 43 | FUCYC | FUSING ON-CYCLE | B | |
| 44 | DRTEMP | DRUM TEMPERATURE | C | |
| 45 | DRDEG | DRUM TEMPERATURE IN °C | D | |
| 46 | DRCYC | DRUM ON-CYCLE | E | |
| 47 | HRCNT | HOUR COUNTER | F | |
| 48 | DiFF | SOFT START-UP TIMER PHASE ANGLE DIFFERENCE | | |
| 49 | HZCNTL | LOWER BYTES } HAZARD COUNTER | | |
| 50 | HZCNTH | UPPER BYTES | | |
| 51 | SUMSQL | LOWER BYTES } SQUARE SUM | | |
| 52 | SUMSQM | MIDDLE BYTES | | |
| 53 | SUMSQH | UPPER BYTES | | |
| 54 | LMPFLG | LAMP FLAG | | |
| 55 | HETCNT | HEATER CYCLE COUNTER | | |
| 56 | WUCNTF | FUSING HEATER WARM-UP COUNTER | | |
| 57 | FUCNT | FUSING ON-CYCLE COUNTER | | |
| 58 | SUMFTL | LOWER BYTES } FUSING TEMPERATURE SUM | | |
| 59 | SUMFTH | UPPER BYTES | | |
| 60 | iFUTMP | INITIAL FUSING TEMPERATURE | | |
| 61 | FTN2 | 2 TIMES BEFORE VALUE } FUSING TEMPERATURE | | |
| 62 | FTN1 | PREVIOUS VALUE | | |
| 63 | FTNØ | CURRENT VALUE | | |
| 64 | STBNDL | CYCLE DECISION BOUNDARY (LOWER LIMIT) | | |
| 65 | STBNDH | CYCLE DECISION BOUNDARY (UPPER LIMIT) | | |
| 66 | PREFUT | FUSING TEMPERATURE AT PREVIOUS COPYING | | |
| 67 | ADSET | FUSET - (IFUTMP) | | |
| 68 | FUPCNT | SETTING VALUE UP-COUNTER | | |
| 69 | HETFLG | HEATER FLAG | | |
| 70 | WUCNTD | DRUM COUNTE WARM-UP COUNTER | | |
| 71 | SUMDTL | LOWER BYTES } DRUM TEMPERATURE SUM | | |
| 72 | SUMDTH | UPPER BYTES | | |
| 73 | DRCNT | DRUM ON-CYCLE COUNTER | | |
| 74 | DTN2 | 2 TIMES BEFORE VALUE } DRUM TEMPERATURE | | |
| 75 | DTN1 | PREVIOUS VALUE | | |
| 76 | DTNØ | CURRENT VALUE | | |
| 77 | iDRTMP | INITIAL DRUM TEMPERATURE | | |
| 78 | ZCPCNT | ZERO-CROSS COUNTER | | |
| 79 | RUNCNT | RUNNING COUNTER | | |
| 80 | MUCNT | MINUTE COUNTER | | |
| 81 | BRNCNT | BRANCH COUNTER | | |
| 82 | DSPCNT | DISPLAY COUNTER | | |
| 83 | iNPSTA | INPUT STATUS | | |
| 84 | SELDiS | DISPLAY DATA SELECTION | | |
| 85 | BCDLO | LOWER BYTES } BCD CODE | | |
| 86 | BCDHi | UPPER BYTES | | |
| 87 | OUTFLG | OUTPUT BUFFER FLAG | | |

(i) LMPFLG

| 7 | 6 | 5 | 4 | 3 | 2 | 1 | Ø |
|---|---|---|---|---|---|---|---|
| | | | | | | | SOFT |
| | | | | | | REGUON | |
| | | | | | LAMPOF | | |

(ii) HETFLG

| 7 | 6 | 5 | 4 | 3 | 2 | 1 | Ø |
|---|---|---|---|---|---|---|---|
| | | | | | | | FiXFUC |
| | | | | | | FUCMAX | |
| | | | | | iNiTMP | | |
| | | | | FSTCPY | | | |
| | | | FUSDRM | | | | |

(iii)

| 7 | 6 | 5 | 4 | 3 | 2 | 1 | Ø |
|---|---|---|---|---|---|---|---|
| | | | | | | | HAZARD |
| | | | | | | HETFLG | |
| | | | | | ZCPLO | | |

ROOT
(SQRCNT) ← SQRTiM
(SQR) ← TYPSQR
< SQRLP >
(DiVISR) ← (SQR)
(XA) ← (RHi)
(A) ← (RLO)
DiVIDE
(A) ← (XA)(A)/(DiVISR)
(A) ← (A)+(SQR)
RRC
(SQR) ← (A)
(SQRCNT) ← (SQRCNT) − 1
(SQRCNT) = 0?
N
Y
RET

CALRMS
(DiVISR) ← SPTiM
(XA) ← (SUMSQH)
(A) ← (SUMSQM)
DiVIDE
(A) ← (XA)(A)/(DiVISR)
RHi ← (A)
(A) ← (SUMSQL)
DiVIDE
(A) ← (XA)(A)/(DiVISR)
(PLO) ← A
ROOT
(SQR) ← √(RHi)(PLO)
(RMS) ← (SQR)
RET (A)(MPLiER)←(MCAND)x (MPLiER)

ALTERNATING CURRENT LOAD POWER CONTROLLER

BACKGROUND OF THE INVENTION

The present invention relates to alternating current (AC) load power control in which AC power is supplied to a load under on-off control, the power actually applied to the load is detected, and the detected value is compared with the setting value to maintain the load power at a predetermined value.

In reproducing machines, for example, if the intensity of light emitted from an exposure lamp is not held constant, variations in the intensity of light will appear as a lack of uniformity in the copied image. Thus, it is important to accurately control the power applied to the load.

Such control is generally performed by phase control. In other words, an AC power source is employed to energize the load for a range of certain phase during each cycle of the power source, and the energizing phase is adjusted to control the load power. A generally used control system has a closed loop in which the voltage or current actually applied to the load is sampled to detect the actual load power, and the detected value is then compared with the setting value to determine a controlled amount (energizing phase angle).

Meanwhile, load power is changed attributable to variations in the source voltage. When attempting to phase-control the load power, those variations in the source voltage can be compensated to maintain the load power constant by detecting the source voltage and feeding back the detected information to the control process for correction of the energizing phase angle. In this case, however, if there is a time lag in the process of compensation control, the load power would change in such a period of lag time, and if the source voltage is erroneously detected, precise compensation would not be ensured.

Generally, in conventional feedback control, the detected value is compared with the target value and a minute value is added to or substracted from a control parameter dependent on the result of such comparison. Control of this type is performed satisfactorily in cases where the difference between the detected value and the target value is relatively small. But, in cases where that difference becomes larger due to abrupt changes the voltage source, the compensation process must be repeated many times to reduce that difference to zero and a longer period of time is required for complete compensation, during which time the load power may be continuously changed.

Furthermore, a conventional feedback control, the load voltage (or source voltage) is detected by calculating the average value with a CR integration circuit or microcomputer. In the system of this type, however, the form factor, peak factor, etc. would be changed if the waveform of the source voltage is not square, so that an error is enlarged which may occur in power actually applied to the load. Particularly, in the application fields, such as reproducing machines, where the large load is subjected to switching control (phase control), the waveform of the source voltage is largely different from that of a square wave and changed temporally in many cases. An error occurring in the detected data causes in turn an error in control, thus making it possible to maintain the load power constant.

SUMMARY OF THE INVENTION

The present invention has for its first object to promptly compensate a controlled amount of a load with respect to variations in source voltage, thereby maintaining load power constant at all times, and for its second object to restrain and adverse influence due to the noise component included in power supplied from a power source.

Relatively satisfactory control is attained using a switching device adapted to on/off-control the supply of load power, and a microcomputer adapted to control the switching device, for example, in such a manner that processes of "lamp voltage sampling", "square integration of lamp voltage" and "average, root and proportional calculations of lamp voltage" are sequentially implemented each half cycle of the AC source waveform, as shown at "software processing I" in FIG. 1*a*, thereby performing one round of the power control loop processing in a time corresponding to 1.5 cycles of the source waveform. In this case, it has been found that, in practice, the loop processing must be implemented two or three times with the aid of simulation and experiment until the lamp voltage (i.e., voltage applied to the load) approaches and becomes equal to the target value from its starting state different therefrom and then gets into a stabilized state. Thus, a time corresponding to 3–4.5 cycles of the source waveform is the response time of this type controller. A reduction in this response time improves the accuracy of load power hold control with respect to those disturbances that are changed rapidly.

In processing of this type, the square and root calculations are time-consuming. According to the present invention, therefore, sampling of data corresponding to the load power and the process of square calculation are alternately implemented to complete those processes in at least a half cycle of the source waveform, so that a response time of the controller is shortened. As shown at "software processing II" in FIG. 1*a* by way of example, this permits one round of processing loop to be executed for a time corresponding to 1 cycle of the source waveform.

On the other hand, an instruction executing time of microcomputers is previously set in accordance with the type of microcomputer and the clock cycle used. Hence, when performing the same processing with the same hardware architecture, it is impossible to reduce the time required to that processing. Accordingly, by employing an inexpensive hardware unit, timing of those processes of "lamp voltage sampling", "square integration of lamp voltage" and "average, root and proportional calculations of lamp voltage" must be allocated to each half cycle of the source waveform. To shorten the length of a control cycle by making use of a usual hardware unit, the number of steps in each process must be reduced.

Among those processes, it is the process of sampling the value corresponding to the load power that permits a substantial reduction in the number of steps. More specifically, although respective data must be sampled at a number of time points to determine the effective value of the load power, the similar process can be implemented even if the number of sampling times is reduced. Thus, the number of sampling times of data must be reduced when putting the present invention into practice. However, this causes a shortage in quantity of data and hence the resulting data on the effective voltage becomes incorrect.

According to a preferred embodiment of the present invention, additional data is interpolated by calculation between every two successive predetermined time points at which the data (load voltage) is actually sampled, so that the apparent number of sampling times will not be reduced. More specifically, as shown in FIG. 1*c* by way of example, the data is actually sampled at the respective time points n−1, n and n+1, while the additional data is interpolated at the centers between the time points of n−1 and n as well as between the time points n and n+1. The interpolated data may be the average value of data sampled at the preceding time point and the succeeding time point with respect thereto, e.g., [D(n−1)+Dn]/2 at the intermediate time point between n and n−1. By so doing, the data are obtained at twice the number of actual sampling times. It is to be noted that the number can be further increased by changing the method of interpolation.

In case of determining the effective voltage by producing a part of the data with such interpolation process, the sampling data are averaged so that an effect similar to that of a noise filter is attained. In practice, experimental results have proven that the case where the voltage is determined by obtaining n data and then producing the interpolated data exhibits more preferable characteristics than the case where the voltage is determined after obtaining 2n data without interpolation.

Meanwhile, when sampling the load voltage, the data is generally sampled at the predetermined intervals from one zero crossing point to the next zero crossing point for each AC cycle, i.e., at the preset timing, as shown at I in FIG. 1*b*. A number of the resulting data are employed to determine the effective value, etc. However, because of the finite number of sampling times, the time interval of sampling is substantially large.

In this connection, when the energizing phase angle of the load has a value dependent on the relationship between energizing timing and sampling timing, either the changes in the energizing phase angle will not significantly affect the detected result, or just slight changes in the energizing phase angle will largely affect the detected result, so that the detected value is varied stepwise. Such variations in the detected value tend to bring the control system into an unstable state. To stabilize the control system, the system must be designed so as not to respond to small changes, as a consequence of which highly accurate control is difficult to achieve.

According to a preferred embodiment of the present invention, therefore, the data are sampled in synchronism with the energizing phase angle of the load as shown at II in FIG. 1*b*. In this connection, because the load voltage is relatively slowly raised up by a snubber circuit so that its rise time is not instantaneous, sampling is started after the lapse of a predetermined rising time from start-up of energizing, in order to reduce error.

Practically, the above predetermined rise time is set in the embodiment to a half of the time period t2 required for the processes of square calculation and data storing. With this setting, the data produced by interpolation based on the first data becomes always a half of the data sampled at the first time, thus resulting in a reduction of the detected error.

Meanwhile, in controlling a large load, soft start-up control is implemented so that in rush current is made small immediately after power-on. Control of this type is performed as shown in FIG. 1*d*, for example. In FIG. 1*d*, designated at F is a flag, A is an energizing phase angle, V is load voltage, and Vs is a set value of the load voltage.

More specifically, after setting the energizing time to a small predetermined value (Ai) immediately after power-on, the energizing phase angle A is updated by a predetermined adjustment value ΔA to increase the energizing time step by step. In the above control, however, the soft start-up process is repeated until the detected value V has become equal to or larger than the setting value Vs, so the actual load voltage will be larger than the setting value in many instances at the time of completion of soft start-up, thereby causing an overshoot.

According to a preferred form of the present invention, therefore, step S12 is added to the processing loop as shown in FIG. 1*e*. Namely, the soft start-up process is terminated when the difference ΔV between the detected value V and the set value Vs has become equal to or smaller than the adjustment value ΔA. This eliminates a possibility of overshoot occurring during soft start-up. It is to be noted that, although the voltage V and the energizing phase angle A are parameters different from each other in their dimensions, a voltage change per unit variation of the energizing phase angle A is previously set to coincide with a unit change of the voltage V in FIGS. 1*d* and 1*e*, allowing A and V to directly undergo comparison, calculation, etc.

On the other hand, when the control target value is set adjustable in digital controllers, there is provided a switch for specifying the set value. But, to permit the target value to be adjustable in a multistaged fashion, a number of switches must be set and hence the cost of the controller is increased.

According to a preferred embodiment of the present invention, therefore, means capable of continuously setting the desired levels, such as a variable resistor, is provided to determine the target value using the data obtained by A/D conversion of an output level of that means. With this arrangement, it becomes possible to set the target value in a multistaged fashion with an inexpensive construction.

BRIEF DESCRIPTION OF THE DRAWINGS

FIGS. 3*b*, 3*c*, 3*d* and 3*e* are maps showing allocation to respective memories and ports of the microcomputer 1; and FIGS. 3*f*, 3*g*, 3*h*, 3*i*, 3*j*, 3*k*, 3*l*, 3*m*, 3*n*, 3*o*, 3*p*, 3*q*, 3*r*, 3*s*, 3*t*, 3*u*, 3*v*, 3*w*, 3*x*, 3*y*, 3*z*, 4*a*, 4*b*, 4*c*, 4*d*, 4*e*, 4*f*, 4*g*, 4*h*, 4*i*, 4*j*, 4*k*, 4*l*, 4*m*, 4*n*, 4*o*, 4*p*, and 4*q* are flow charts showing the operation of the microcomputer 1.

DESCRIPTION OF A PREFERRED EMBODIMENT

In the following, a preferred embodiment of the present invention will be described with reference to the drawings.

Figure 1A:
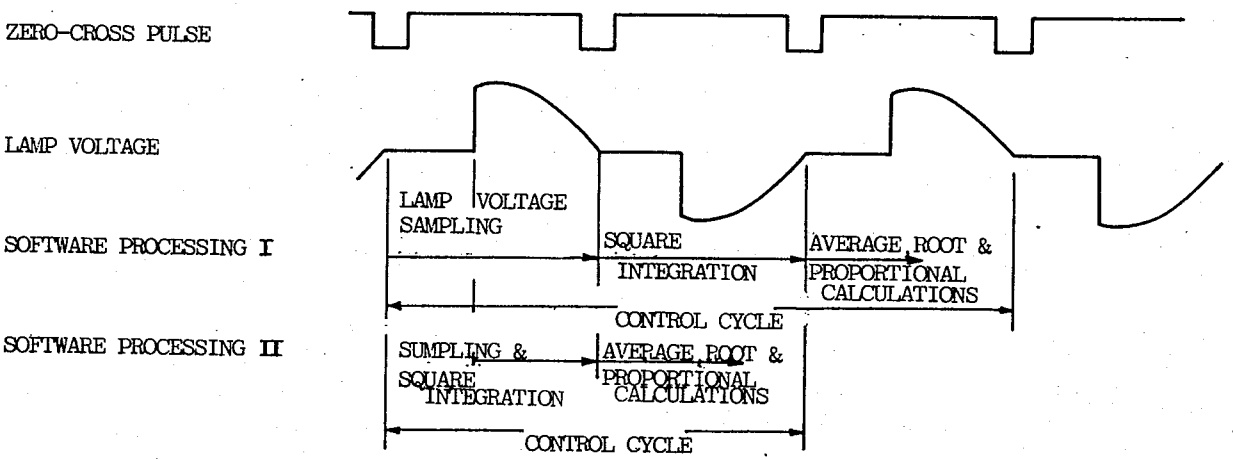
FIGS. 1*a*, 1*b* and 1*c* are timing charts showing the operation of a controller to which the present invention is applied.
Figure 1B:
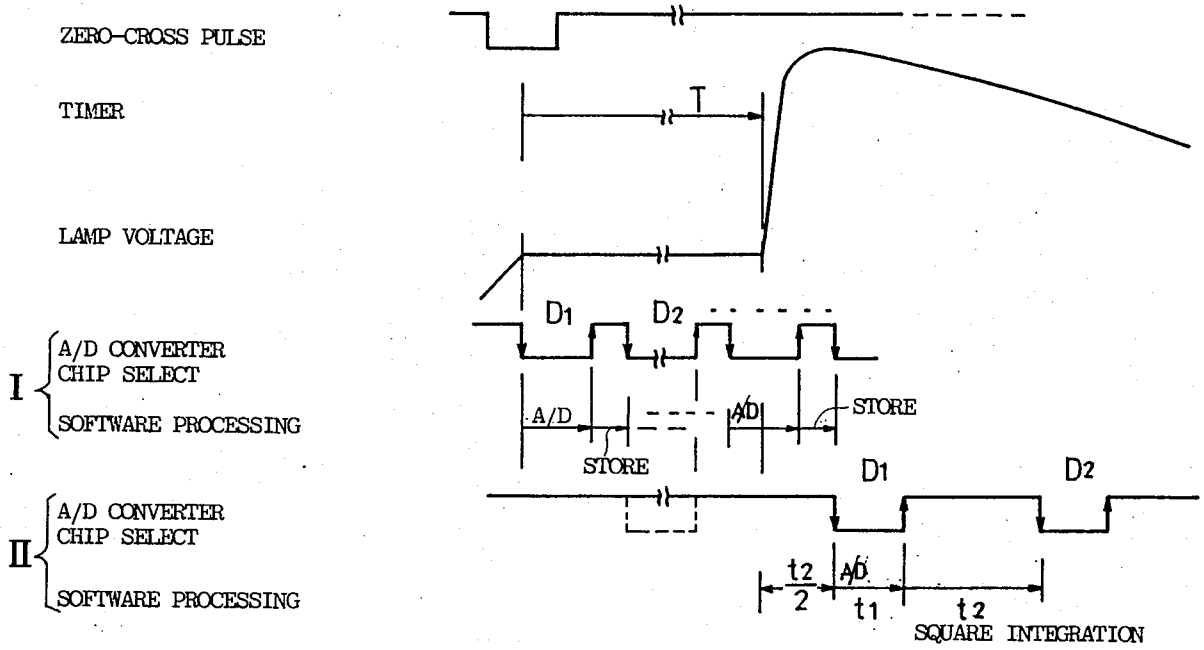
Figure 1D:
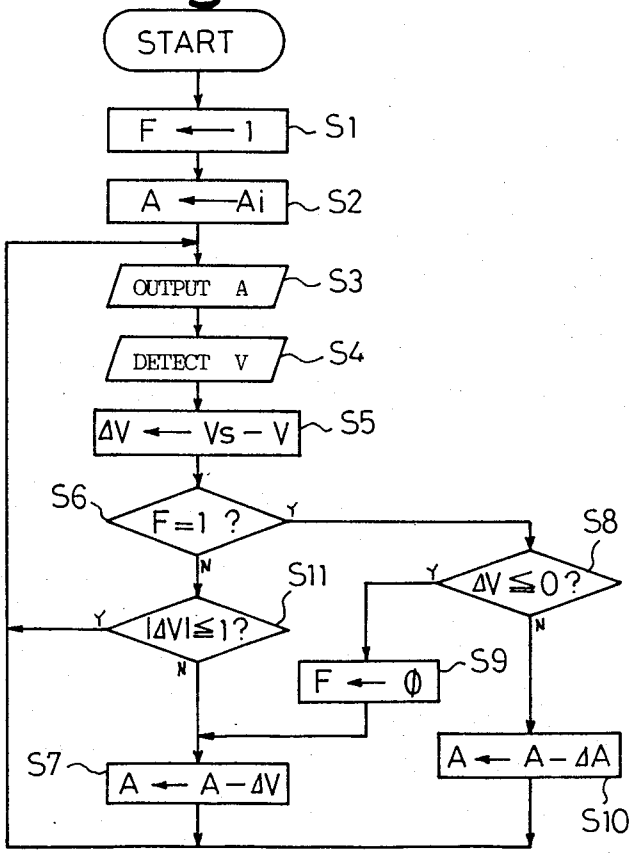
FIGS. 1*d* and 1*e* are flow charts each schematically showing the soft start-up operation.
Figure 1C:
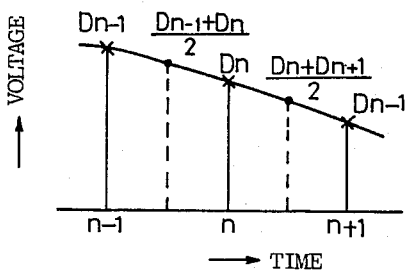
Figure 1E:
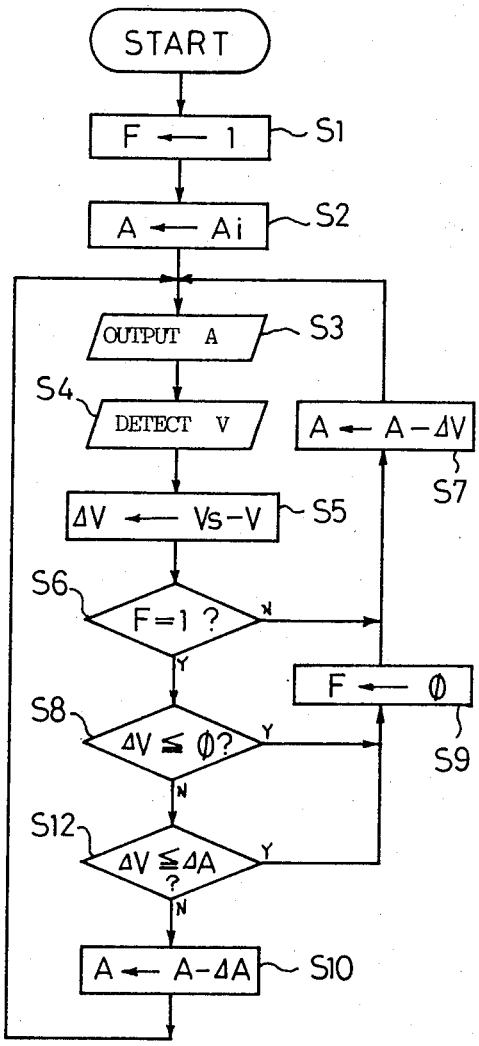
Figure 2A:
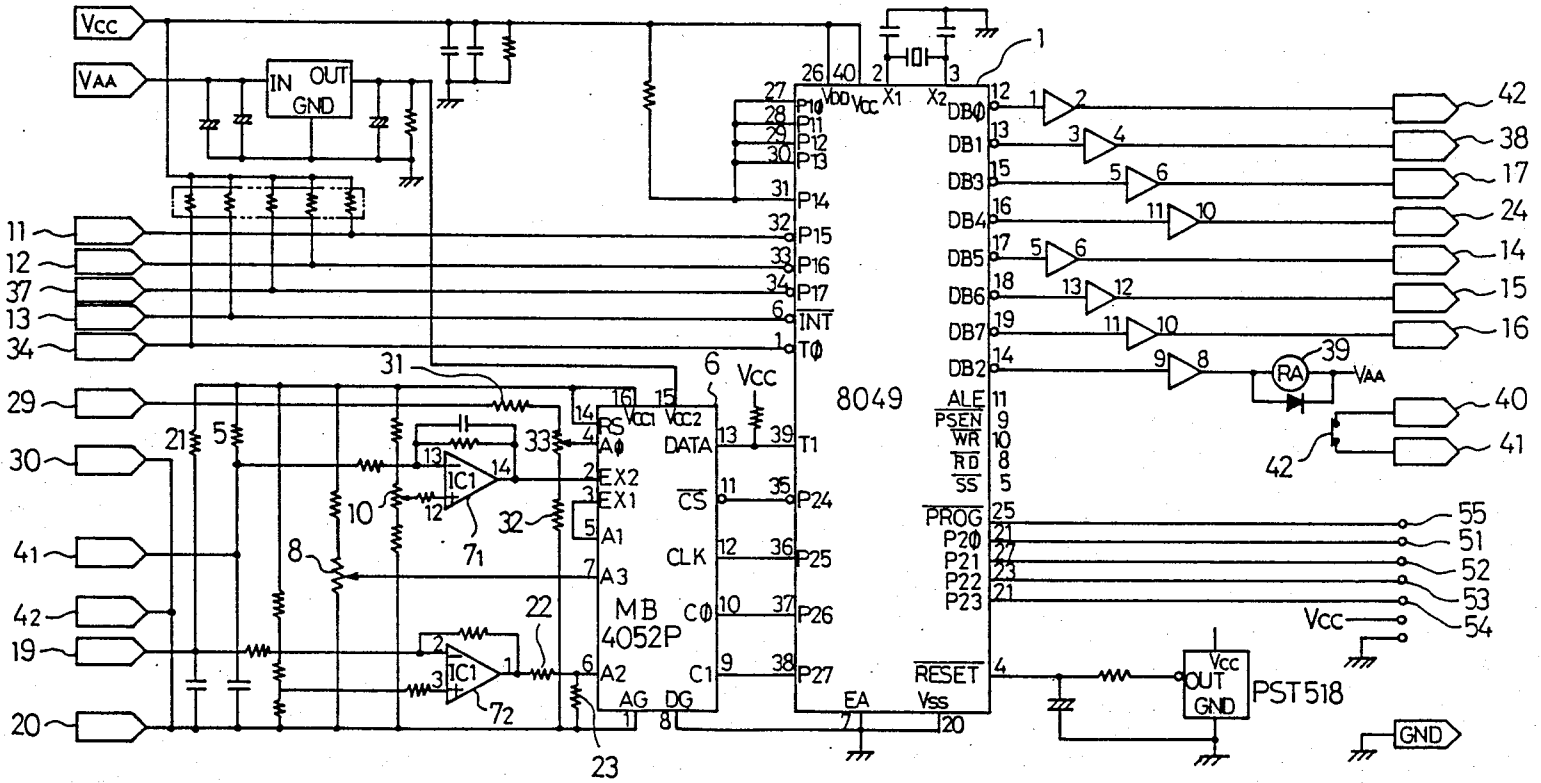
FIGS. 2*a* and 2*b* are block diagrams each showing an electric circuit of the controller of one embodiment.
Figure 2B:
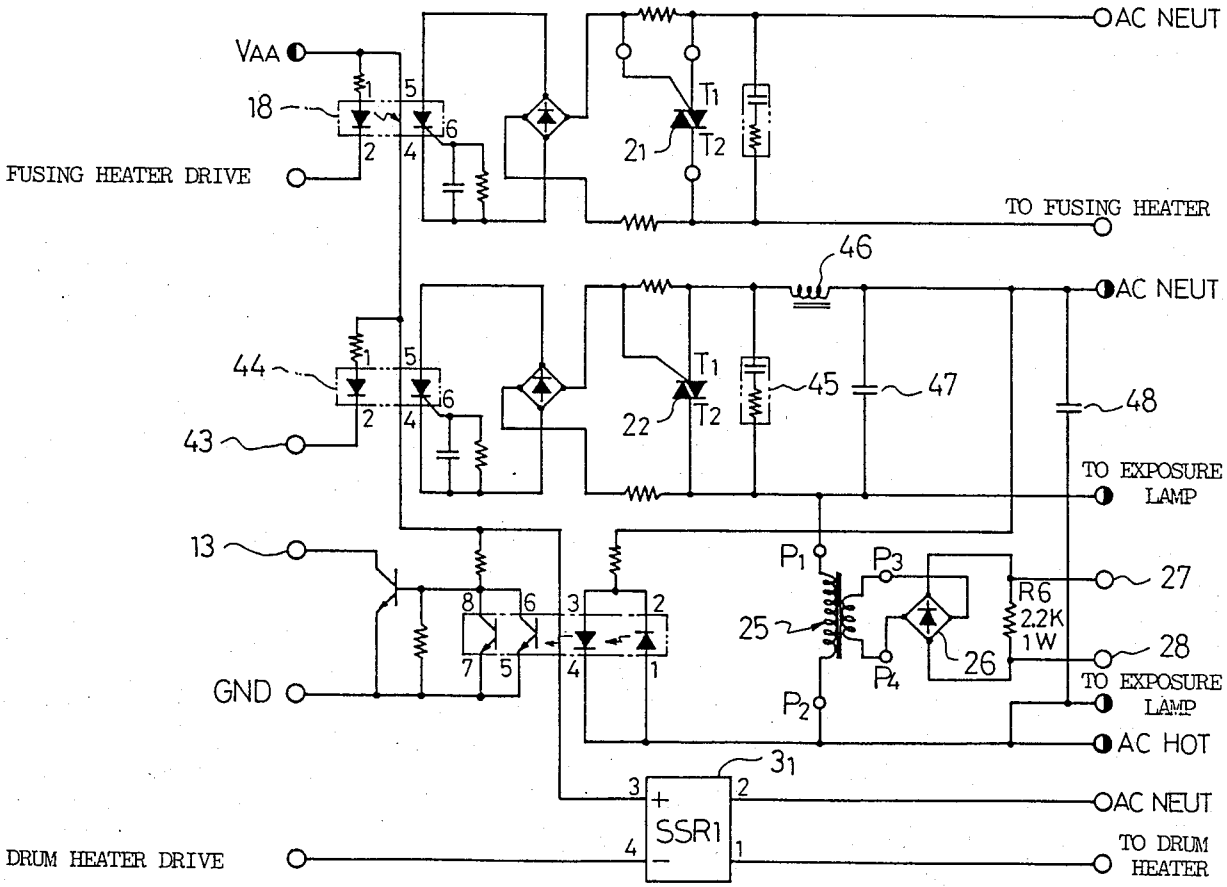
Figure 2D:
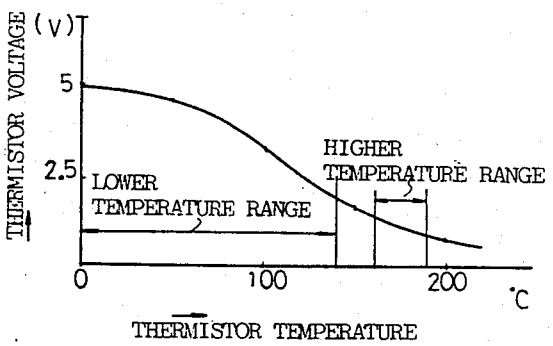
FIGS. 2*c* and 2*d* are graphs showing characteristics of a thermistor.

FIGS. 2*a* and 2*b* show the circuit configuration of the embodiment. Referring to FIG. 2*a*, the illustrated circuit is composed of a microcomputer 1 and input/output signal circuits connected to input/output ports thereof. To other input ports of the microcomputer 1, though not shown in the figure, there are connected a detection circuit of voltage applied to an exposure lamp, a thermistor for detecting the temperature of a fusing heater, a zero-cross circuit for issuing a pulse signal at the zero crossing points of the source AC waveform, etc. These detection circuits are all well known. Referring now to FIG. 2*b*, the illustrated circuit is composed of load driving triacs $2_1$, $2_2$, solid state relays $3_1$, etc. The object of this circuit is to control the temperature of a fusing section of a reproducing machine, the temperature of a photosensitive drum, and the intensity of light emitted from the exposure lamp. In FIG. 2*b*, serially connected to the triac $2_1$ are a commercial power source and a fusing heater serially, connected to the triac $2_2$ are the commercial power source and the exposure lamp and serially connected to the solid state relay $3_1$ are the commercial power source and a photosensitive drum heater. The microcomputer 1 controls the exposure lamp in the conducting phase of each of the successive waveforms, as well as the fusing heater and the drum heater in their conduction at the zero crossing point of each waveform.

Temperature control of the fusing heater and the drum heater will be first described, and voltage control of the exposure lamp will be described second.

Figure 2C:
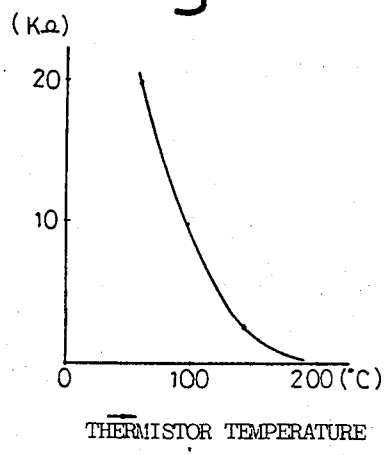

In FIG. 2*a*, the temperature of the fusing heater is detected by a thermistor (not shown) connected to a terminal 4. As shown in FIG. 2*c*, the thermistor exhibits a non-linear temperature-resistance characteristic. A resistor 5 serially connected to the thermistor functions to correct such a non-linear characteristic of the thermistor. The voltage applied to the thermistor and the resistor 5 connected serially is a stabilized voltage of +5 V output from Vccl (No. 16) of an A/D converter. Accordingly, in response to temperature changes of the thermistor, there is produced the voltage as shown in FIG. 2*b* across the thermistor. A/D conversion of the thermistor voltage provides a digital value corresponding to an analog value of the fusing heater temperature.

The temperature detection circuit is formed of an inverting amplification circuit using an operational amplifier $7_1$ in which the thermistor voltage of 1.0–5.0 V (corresponding to the thermistor temperature of 0°–210° C.) is invertedly amplified to 1.0–10.0 V. Further, because an analog input terminal $A_1$ of the A/D converter 6 has 2.5 V in its full scale, an output signal obtained by dividing the output voltage of the operational amplifier is applied to A1 for matching. More specifically, an output of the operational amplifier $7_1$ is connected to EX2 of the A/D converter 6 and an output from EX1 is connected to the analog input terminal A1, while an output of an operational amplifier $7_2$ is divided to a half by resistors 22, 23 and then connected to an analog input terminal $A_2$. Incidentally, a variable resistor 10 is provided to adjust fluctuations in the temperature characteristic of the thermistor.

Analog temperature information input to A1 of the A/D converter 6 is selected by channel select signals (C0, C1). A chip select signal (CS) brings the A/D converter 6 into an operable state, and an A/D conversion clock signal (CLK) causes the analog signal to be sequentially converted to an 8-bit digital signal from the most significant bit. This digital signal is issued from an output terminal (DATA) to be applied to an input terminal T1 of the microcomputer 1. As a result, the A/D converted data input to the microcomputer 1 have digital values of 25–255 corresponding to the fixing heater temperature of 0° C.–210° C.

Digital temperature input to the microcomputer 1 has been described hereinabove. Other input and output signals will be explained below.

A signal applied from a terminal 11 to an input port P15 of the microcomputer 1 is a fusing roller rotating signal which becomes active at a level of "L". This signal is output from a reproducing process controller, (not shown) and assumes H during the stand-by condition (fixing rollers in a stopped state) but turns to L when the copying operation has begun, i.e., when the fusing rollers have started to rotate. A signal applied from a terminal 12 to an input port P16 of the microcomputer is used for lowering the target temperature of the fusing heater, the signal becoming active at "L". With the reproducing machine in a state of waiting for the copying operation to start, it is not necessary for the fusing heater temperature to be always held at the target value. Therefore, this signal is applied in the stand-by condition to restrain the fusing heater temperature in a lower range, while it is released in a copy mode to raise the temperature up to the target value. This is a useful function from the standpoint of energy saving.

Output signals from an output port DB5 of the microcomputer to a terminal 14, from port DB6 to a terminal 15 and from port DB7 to a terminal 16 are a reload signal, heater anomaly signal and a prereload signal, respectively, these signals all coming active at "L". The reload signal is issued when the fusing heater gets into a state higher than the target temperature (175° C.), and the heater anomaly signal is issued when the fixing heater has come to the temperatures higher than 205° C. The prereload signal is issued when the fusing heater has reached a range within the temperature difference preset with respect to the target temperature during the rising stage of its heating.

Then, an output signal from a port DB3 of the microcomputer to a terminal 17 is a trigger signal for the triac $2_1$ adapted to drive the fusing heater in the circuit of FIG. 2*b*, the signal coming active at "L".

From a terminal 13 to an interrupt input terminal INT of the microcomputer 1, there is applied a signal which turns to an "L" level in synchronism with zero crossing points of the commercial power source. This signal is output from the terminal 13 of the circuit in FIG. 2*b*.

In the above, transmission of signals for controlling the fusing heater has been explained mainly in connection with the microcomputer 1 of FIG. 2*a*. The operation of the fusing heater driving triac $2_1$ will be mainly described by referring to FIG. 2*b*. A signal applied to a terminal 17 becomes active at "L" and, when it has come "L" promptly in response to falling of a zero-cross signal, a photo thyristor 18 conducts due to the light radiated from its light emitting diode. This causes a current to pass through the gate of the triac $2_1$, so that it conducts between T1 and T2. On the other hand, the triac $2_1$ is cut off at the time when the terminal 17 assumes "H" in response to rising of the zero-cross signal and the photo thyristor 18 is turned off so that the gate current stops flowing and gets less than a holding current at the zero crossing point. Thereafter, the triac remains cut off until the next trigger instruction will arrive.

In this manner, the triac $2_1$ undergoes on-off control upon zero crossing and the temperature of the fusing heater is held constant by changing the on-to-off ratio. This ratio is in accordance with the given distribution determined within a basic period of 48 cycles of a semi-square wave.

The foregoing is the description of fusing heater control. Drum heater control will be explained below. The control operation of the drum heat is nearly same as that of the fusing heater and hence will be explained briefly.

The temperature of the drum heater is detected by a thermistor connected to terminals 19, 20 in FIG. 2*a*. Non-linearity of the thermistor is corrected by a resistor 21 serially connected thereto, so that the thermistor voltage exhibits a substantially linear characteristic in the detection range of the drum heater temperature, i.e., 0°–50° C. The thermistor voltage of 5–3 V is inverted to 3–5 V and then output from the operational amplifier $7_2$. For matching with the full scale (2.5 V) of an analog input terminal $A_2$ of the A/D converter 6, output voltage of the operational amplifier $7_2$ is divided to a half by resistors 22 and 23. The operation of converting an analog signal applied to the input terminal $A_3$ to a digital value and applying the digital value to the microcomputer 1 is same as that in case of detecting the temperature of the fixing heater.

A signal applied from an output port DB4 of the microcomputer 1 to a terminal 24 is a trigger signal for the solid state relay $3_1$ adapted to drive the drum heater in FIG. 2*b*, the signal coming active at "L". Also in the drum heater control, similarly to the fusing heater control, a drum heater temperature signal detected by the thermistor is processed by the microcomputer 1 and the solid state relay $3_1$ is subjected to on-off control upon zero crossing to maintain the drum heater at the desired temperature.

The schematic control operation of both the fusing heater and the drum heater has been completely described hereinabove.

Figure 2E:
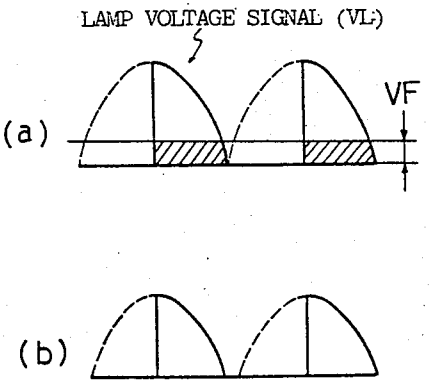
FIG. 2*e* is a set of waveform charts showing a lamp voltage signal.

Control of the exposure lamp voltage will now be explained below. In FIG. 2*b*, the lamp voltage is detected by the primary winding of a transformer 25 connected to a lamp in parallel, and issued as a low-voltage secondary circuit signal from the secondary winding. Then, by subjecting the output signal to full-wave rectification by a diode bridge 26, there is obtained a cyclic signal with its half wave being analogous to the lamp voltage. A lamp voltage signal VL subjected to full-wave rectification and forward voltage drop voltage VF across the diode bridge 26 are shown in (a) of FIG. 2*e* in superimposed relation. It is more desirable for VF to be smaller with respect to VL. If otherwise, the detection accuracy is degraded. In this embodiment, VL is set at 25 Vrms to have a greater value than VF ($\approx$1.2 V). It is to be noted that, although the voltage VL is desirable to be as high as possible, it should be set at a level (less than 30 Vrms) which can be regarded as belonging to a secondary circuit in accordance with the overseas security standards (UL).

The lamp voltage signal is output from terminals 27, 28 and applied to terminals 29, 30 in FIG. 2*a*. This signal is then divided by resistors 31, 32 and a variable resistor 33 to provide an analog input signal (Ao) to the A/D converter 6. The variable resistor 33 serves to make full scale adjustment of an Ao input (2.5 VMAX) and is set such that the peak value of the lamp terminal voltage corresponds to the full scale of Ao.

The analog signal applied to an input terminal Ao of the A/D converter 6 is selected by channel select signals (C0, C1). When the A/D converter 6 is brought into an operable state by the chip select signal (CS), the A/D conversion clock signal (CLK) causes the analog signal to be sequentially converted to an 8-bit digital signal from the most significant bit, the digital signal being applied as serial data to T1 of the microcomputer 1 from the output terminal DATA.

In the above, the digital lamp voltage signal input to the microcomputer 1 has been described. There will be described below other input and output signals applied to the microcomputer 1 in connection with the lamp voltage control.

A signal applied from a terminal 34 in FIG. 2*a* to a test input terminal To of the microcomputer is used for starting to light up the exposure lamp, the signal coming active at "L".

A signal applied to an input terminal $A_3$ of the A/D converter 6 is used for setting the lamp voltage. In this example, the lamp voltage can be set to change over 62 steps in a range of 46–84 V by adjusting a value of the variable resistor 8.

A signal applied from a terminal 37 to P17 of the microcomputer 1 serves to raise up the current setting lamp voltage by a certain level. A signal output from a port DB1 of the microcomputer 1 to a terminal 38 serves to inform the outside of the fact that the exposure lamp is lighting up. When the analog signal is applied to the input terminal Ao of the A/D converter, the above signal is issued. It also becomes active at "L".

Port DB2 of the microcomputer 1 is also an "L"-active terminal and turns to L when analog input voltage is kept continuously applied to the input terminal Ao of the A/D converter 6 exceeding a certain period of time. This signal operates a relay 39 to open its contact 42, thereby issuing an output to the exterior from terminals 40 and 41. The contact 42 is connected to a line for supplying the commercial source power to the controller, thereby preventing the exposure lamp from being left lit up.

Finally, a signal output from a port DB0 of the microcomputer 1 to a terminal 42 serves to trigger the exposure lamp driving triac $2_2$ in FIG. 2*b*, the signal also coming active at "L".

The operation of the exposure lamp driving triac $2_2$ will be mainly described below by referring to FIG. 2*b*. A terminal 43 turns to "L" (active) after a certain time determined in accordance with the phase control has lapsed from the zero crossing point. Upon turning of the terminal 43 to "L", a photo thyristor 44 is conducted due to the light radiated from its light emitting diode. This causes a current to pass through a gate of the triac $2_2$, so that it is conducted between T1 and T2. Then, when the terminal 43 turns to "H" at the next zero crossing point and the gate current of the triac $2_2$ gets less than a holding current, the triac $2_2$ is cut off and the process proceeds to the next phase control mode.

A CR absorber 45 is a snubber circuit, and a coil 46 and capacitors 47, 48 constitute a low-pass filter for absorbing high-frequency noises produced from switching of the triac $2_2$. Meanwhile, the triac $2_2$ will not produce high-frequency noises due to switching thereof, because it is turned on and off only at the zero crossing points.

Before coming into the detailed description of the operation, the following Table 1 shows the correspondent relationship between names of signals applied to the respective terminals shown in FIGS. 2*a* and 2*b* (or terminal names) and part numerals shown in FIGS. 2*a* and 2*b* as well as later-used in the following description.

TABLE 1

| No. | Name | Note |
|---|---|---|
| 1 | IC5 | Microcomputer |
| $4_1$,$4_2$ | FUTEMP | Fusing heater temperature |
| 6 | IC2 | A/D converter |
| 11 | TEMPUP | Rotation of fusing roller |
| 12 | TEMPDN | Preheating signal |
| 13 | ZCP | Zero crossing pulse |
| 14 | RELOAD | Reload |
| 15 | HETENG | Heater anomaly |
| 16 | PRERLD | Preload |
| 17 | FUHDRV | Fusing drive |
| 19,20 | DRTEMP | Drum temperature |
| 24 | DRHDRV | Drum drive |
| 37 | VOLTUP | Blue extinguishing signal |
| 38 | LAMPON | Lamp-on |
| 42,43 | AMPDRV | Lamp drive |

Figure 3A:
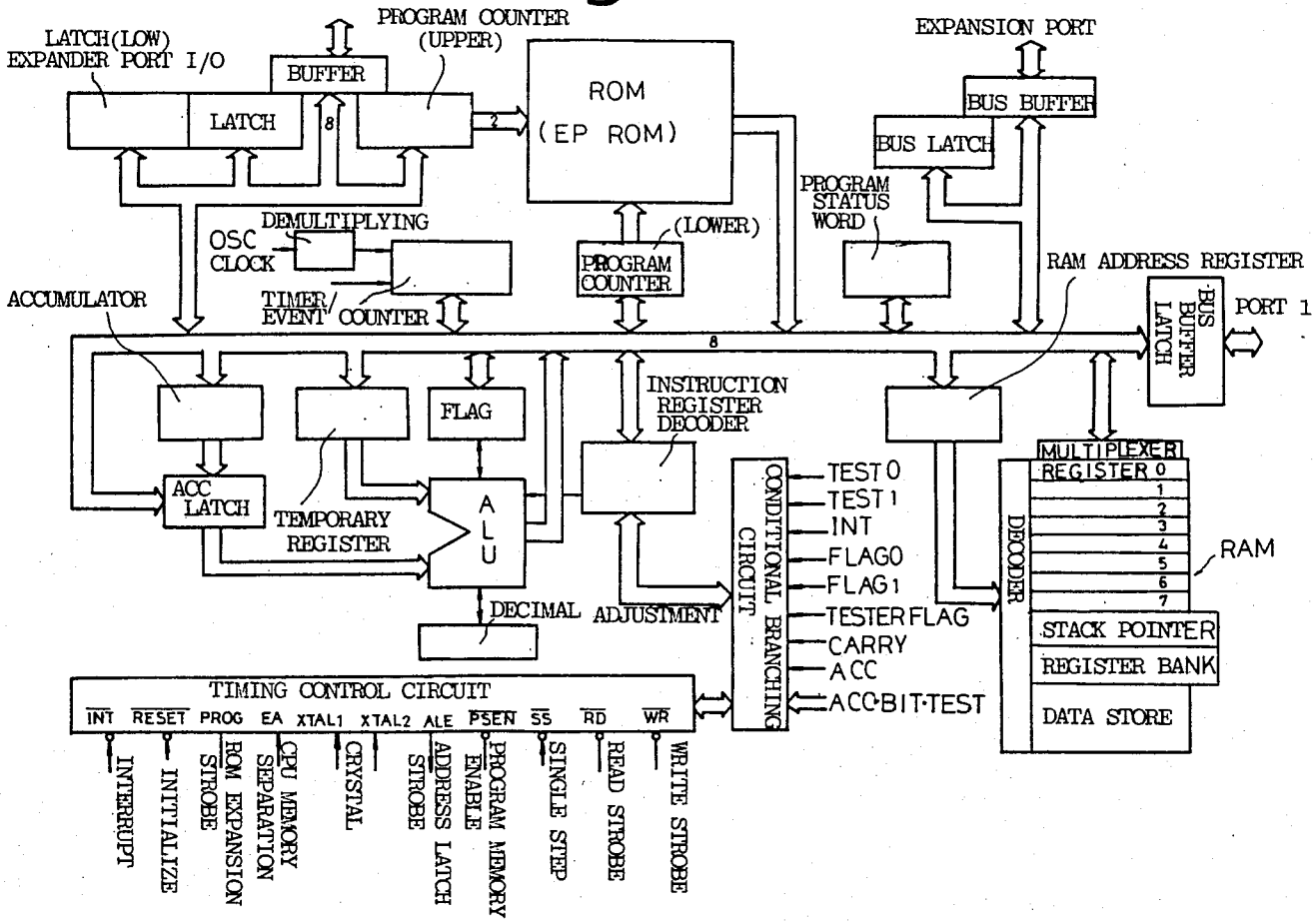
FIG. 3*a* is a block diagram showing the internal configuration of a microcomputer 1.
Figure 3C:
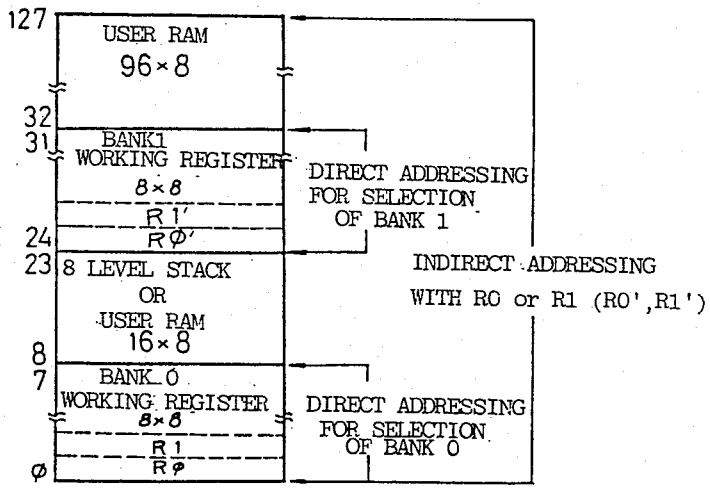
Figure 3B:
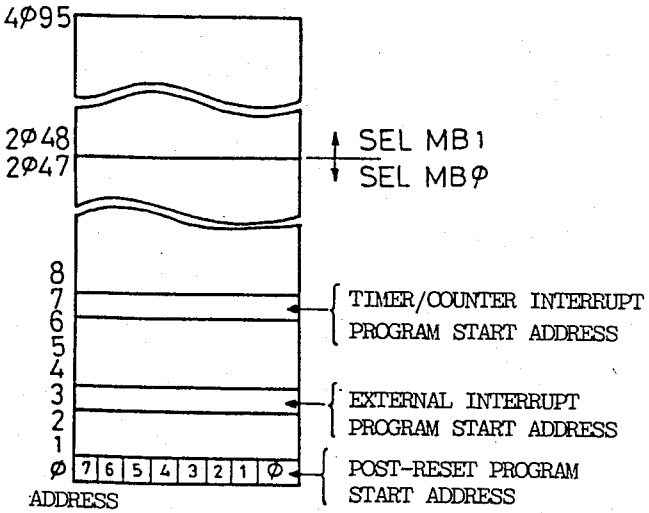

The microcomputer employed in this embodiment is a single-chip microcomputer. The schematic configuration of this microcomputer is shown in FIG. 3*a*, a map of an operation program memory is shown in FIG. 3*b*, and a data memory map is shown in FIG. 3*c*, respectively. The program memory shown in FIG. 3*b* has the following three special addresses:

Address 0 . . . Upon a reest input, instructions start to be executed from the address 0;

Address 3 . . . When an interrupt is enabled, an interrupt signal causes a jump to the subroutine starting from the address 3; and Address 7 . . . If predetermined conditions are satisfied, the occurrence of interrupt due to an overflow of a timer/counter causes a jump to the subroutine starting from the address 7.

In other words, the instruction to be first executed after resetting is stored in the address 0. The first instructions of an external interrupt service routine and a timer/counter service routine are stored in the address 3 and the address 7, respectively.

The program memory is divided into an internal program memory of addresses 0–2047 and an external program memory of addresses 2048–4095, which are referred to as a memory bank 0 and a memory bank 1, respectively. Each memory bank is divided into a multiplicity of pages each having capacity of 256 bytes.

A data memory "RAM" shown in FIG. 3*c* comprises 128 bytes. Addresses of this RAM are all specified indirectly by either one of RAM point registers (R0, R1) located in the addresses 0 and 1 of the data memory. Further, first eight addresses (0–7) of the RAM are each referred to as a working register and can be directly specified. In other words, these registers are termed together as a bank 0 and frequently used for storing the intermediate results which will be accessed in many times.

Addresses 8–23 are designed as 8-level stack resistors each storing two words as a pair, and can be used as normal RAM's if not employed for stacking.

Upon execution of register bank switch instructions (SEL RB1), the part of the RAM corresponding to addresses 24–31 becomes working registers in place of the addresses 0–7 and can now be directly specified. These registers serve as an extension of the foregoing registers (addresses 0–7) and are usually employed for subroutines. Incidentially, these registers have the same function as that of the foregoing registers (addresses 0–7), and can serve as versatile RAM's to be specified indirectly if not employed as registers. Addresses 32–127 provide a versatile RAM region.

The microcomputer has 27 signal lines which comprise three sets of 8-bit ports and three test input ports. These 8-bit ports are termed as a bus port (port 0; bidirectional), a port 1 (quasi-bidirectional) and a port 2 (quasi-bidirectional), respectively. The signal lines are each capable of implementing an input, output or input-/output function.

The ports 1 and 2 have the same function such that the data output to these ports are statically latched and remain unchanged until another set of data will be output again. When they are used as input ports, the data applied from the exterior will not be latched. It is to be noted that the number of ports of the port 2 can be expanded by connecting an I/O expander IC to lower four bits (P20–P23) thereof.

The test input signal lines (T0, T1, and INT) permits signal level testing upon a conditional jump instruction, and to branch the program for each test without loading the data from the port to an accumulator. A program counter comprises 12 bits in which lower eleven bits (0–10) are used for addressing 2024 words in the internal program memory and the most significant bit is used for fetching the external memory. The program counter is initially set to zero after each resetting.

A timer-event counter in FIG. 3*a* serves to count the number of external events or to generate a precise time delay. Although the operation is same in both modes of counter and timer, count input sources are different from each other.

The counter is an 8 bit binary counter which is capable of presetting (Mov T,A) and reading (Mov A,T) of the data upon receipt of a Mov instruction. The content of the counter is not affected by resetting and set by only a Mov T,A instruction. The counter starts as a timer upon receipt of a start timer instruction (STRT T) and starts as an event counter upon receipt of a start count instruction (STRT TCNT). In the latter case, the counter continues to count until it has been stopped upon a stop count instruction (STOP TCNT) or resetting, and gets into an overflow when it has been incremented (or counted up) to the maximum count number ($FF_H$).

After reaching the maximum count number, the counter turns to zero again and, simultaneously, there occurs an interrupt demand. A timer interrupt can be set enabled or disabled upon an enable timer count interrupt instruction (ENT TCNTI) or a disable timer counter interrupt instruction (DIS TCNTI) independently of an external interrupt setting (ENI and DISI). If set to be enabled, when the counter gets into an overflow, the subroutine in the address 7 is executed in which there are stored processing routines for the timer, counter etc.

When the timer interrupt and the external interrupt occur at the same time, the latter has priority over the former so that the subroutine in the address 3 is executed. In such a case, the timer interrupt demand remains latched and this state will be held until the external interrupt processing routine is completed and a return is acknowledged. The timer interrupt demand being held is reset upon a subroutine call of the address 7, or released upon the disable timer count interrupt instruction (DIS TCNTI).

The operation of the timer will be described below. Upon the start timer instruction (STRT T), counting is disabled in a mode where internal clocks are used as input pulses for the counter. The internal clocks are in the form of a signal resulted from dividing machine cycle clocks ALE by 32, (the ALE corresponding to a signal resulted from dividing the oscillation frequency of a quartz by 15). Namely, in case of using a quartz of 11 MHz, the counter is incremented once per 43.6 μsec. Any desirous delay time between 43.6 μsec and about 11 msec (256 counts) can be obtained by presetting the counter at a certain value and the detecting an overflow of the counter.

Figure 3D:
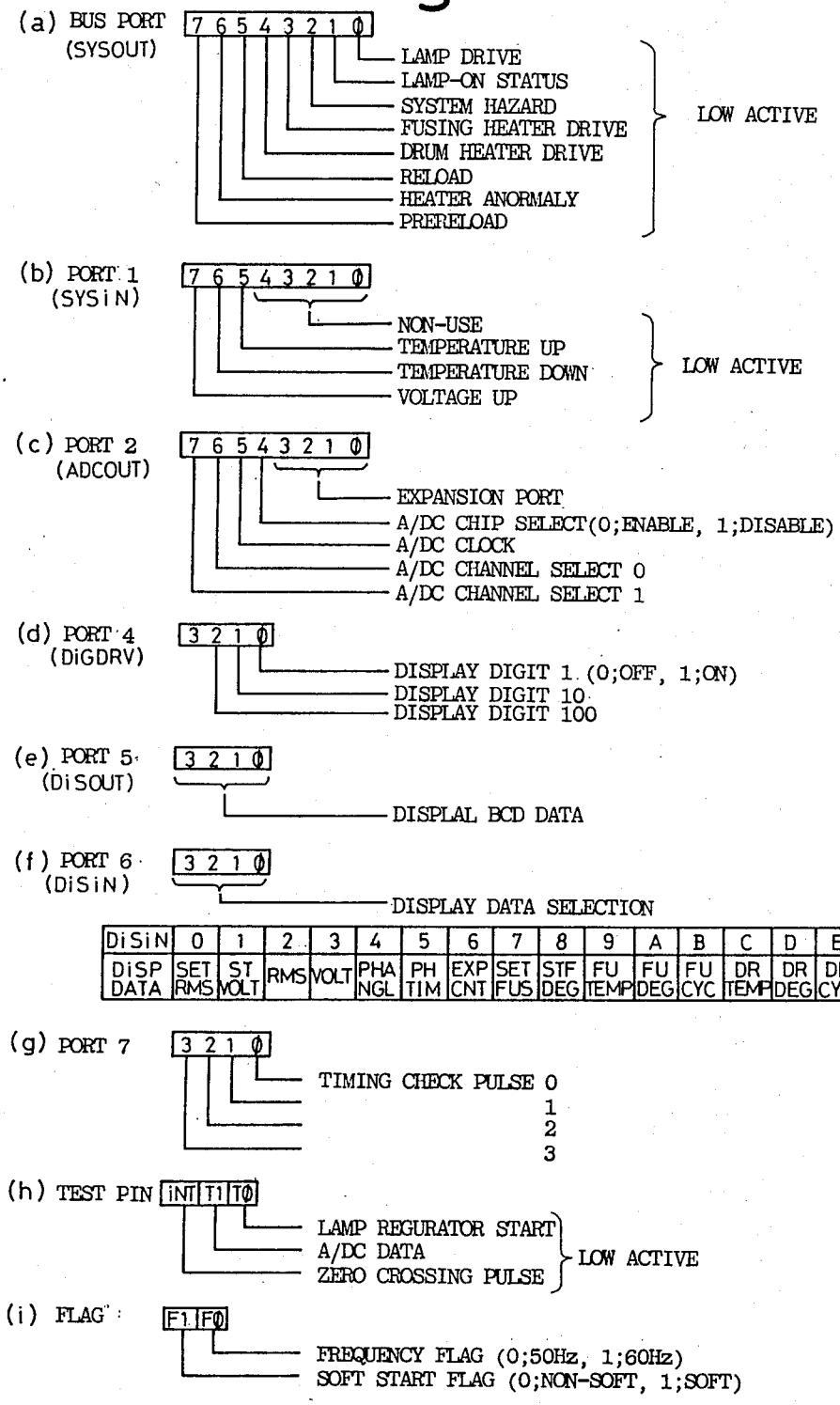

FIGS. 3*d* and 3*e* show allocation of the input/output ports, flags and RAM's of a single component microcomputer IC5 which is employed in this embodiment. Incidentally, the names in FIGS. 3*d* and 3*e* are made coincident with the corresponding flow names in FIGS. 3*f*–4*q* as well as the corresponding terminal names of the control circuit in FIG. 2*a*. The three input/output ports (bus port, port 1 and port 2), three test inputs (T0, T1 and INT), two flags (F0 and F1) and the data memory RAM of the microcomputer IC5 are endowed with their own functions, as shown in FIGS. 3*d* and 3*e*.

The bus port DB issues output signals therefrom such as a lamp drive signal (LMPDRV) (DB0), a lamp on-state signal [LAMPON] (DB1), a system hazard signal [HARZARD] (DB2), a fusing heater drive signal [FUHDRV] (DB3), a drum heater drive signal [DRHDRV] (DB4), a reload signal [RELOAD] (DB5), a heater anomaly signal [HETEMG] (DB6), and a prereload signal [PRERLD] (DB7).

To the port P1 there are input a roller rotating signal [TEMPUP] (P15), a power saving signal [TEMPDN] (P16), and a blue extinguishing signal [VOLTUP] (P17).

To the port P2 there is connected an I/O expander IC, though not shown, for expanding the I/O ports. The I/O expander IC includes ports 4–7 each comprising four bits. In this embodiment, the port 4 is allocated to output a digit driving signal [DIGDRV] for a 7-segment indicator, the port 5 is allocated to output a BCD code signal [DISOUT] indicative of the displayed numerical value, and the port 6 is allocated to input data (real code) for selecting the data to be displayed, respectively. Lower four bits (P20–P23) of the port P2 serve as signal ports for the expander IC. Upper four bits of the port P2 are allocated to output a control signal for the A/D converter IC2, thereby issuing therefrom a chip select signal [ADCCS] (P24), a clock signal [ADCCLK] (P25), a channel select signal [ADSEL1] (P26), and a channel select signal [ADSEL2] (P27), respectively.

The test input port INT is allocated to input the zero crossing pulses, Tl is allocated to input the data [DATA] A/D-converted by the IC2, and TO is allocated to input a lmap light-up start signal [START], respectively.

The flag FO serves as a memory for storing the status data to discriminate between the source frequencies of 50 Hz and 60 Hz, while the flag Fl serves as a memory for storing the status data to discriminate whether or not the zero crossing signal [ZCP] is left at H.

In this embodiment, when using working registers for the service routine [corresponding to the case where the external interrupt or timer interrupt has occurred], an register bank switching instruction SEL RB1 is executed to employ the register group of the bank 1 (addresses 24–31), so that the register group of the bank 0 used for the main program and the subroutines. Then, at completion of the service routine, an instruction SEL RBO is executed to return the working registers to the bank 0.

The operation of this embodiment will be described below. Before coming into the detailed explanation, an outline of the operation will first be desdribed by referring to FIG. 3*f*.

Figure 3F:
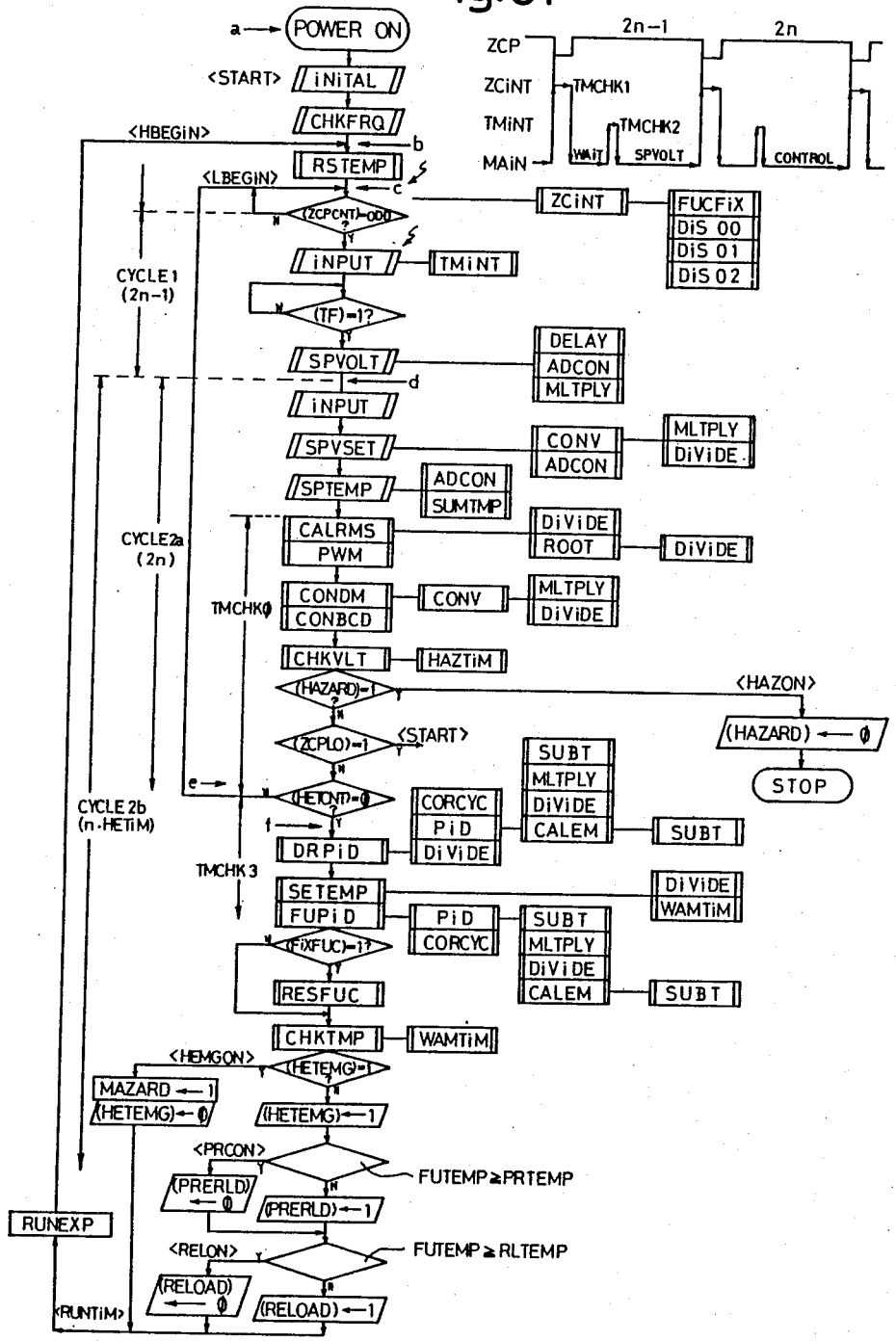

In a schematic flow of FIG. 3*f*, desginated at a-b-c is a routine for initializing the system from the step of power-on to the step before coming into the normal control operation. After the point of c, the microcomputer proceeds to the control operation which comprises three subroutines; i.e., c-d, d-e-c and d-e-f-b-c. Each control routine is executed for each half wave of the AC power source (referred to as a cycle in the description herein) such that a period of cycle 1-cycle 2*a* is repeated 23 times (resulting in 46 cycles in total) and a period of cycle 1-cycle 2*b* is then executed one time (resulting in 2 cycles in total). After that, assuming such 48 cycles as a basic period (referred to as lamp control period), the phase angle of the lamp voltage is updated for each lamp control period. In temperature control of the fusing heater and the drum heater, assuming 48 cycles each comprising cycle 1-cycle 2*b* as a basic period (referred to as a temperature control period), the energizing control amount of the heater is updated for each temperature control period.

The control routines will be briefly described below in order.

c-d (cycle 1): The lamp voltage is sampled, the square of the sampled instantaneous data is added to the square of average value of the previously sampled instantaneous data and the currently sampled instantaneous data, and the resulting sum is stored in the RAM (read-write memory). The above process is repeated until detection of the zero crossing point.

d-e-c (cycle 2*a*): The temperatures of the fusing heater and the drum heater are sampled and the results are stored in the RAM. Then, the effective value (RMS) is determined from the integrated value of the square of lamp voltage obtained in the cycle 1, and the phase angle of the lamp voltage is updated based on that effective value.

d-e-f-b-c (cycle 2*b*): This cycle implements the same control operation as that of the cycle 2*a*. After updating the phase angle of the lamp voltage, the respective average values are calculated from the integrated values of respective temperatures previously sampled (RAM storing therein the data corresponding to the 24 sampling times), and the energizing control amounts adapted to control the temperatures of respective heaters are updated based on those average temperatures.

The function of the timer (T) will be described below. The timer has three functions as follows. The first function is to judge whether the source frequency is 50 Hz or 60 Hz, in the initializing stage of the system starting from power-on. More specifically, upon detecting the zero crossing pulse signal [ZCP], the timer is set at 0 to be started. (In this case, the timer interrupt is disabled.) Then, the timer is stopped upon detecting the next

[ZCP]. In short, a period of time from one [ZCP] to the next [ZCP] is counted to judge the source frequency from the resulting value.

The second function serves as a phase timer for the lamp voltage. More specifically, when the lamp light-up start signal [START] is being issued, the phase angle timer data obtained in the cycle 2*a* or 2*b* is set in the timer upon detection of [ZCP] to start the timer. (The timer interrupt is enabled to the time of initializing the system.) When the interrupt is set upon an overflow of the timer, the process flow jumps to the timer interrupt service routine, so that the lamp drive signal [LMPDRV] is issued to supply power to the lamp.

The final third function is used for decision of an abnormal external interrupt (INT). More specifically, the external interrupt is disabled at completion of an external interrupt routine (ZCINT), and enabled at completion of a timer interrupt routine (TMINT). Accordingly, when [ZCP] is left at L, the external interrupt is set just after completion of the timer interrupt routine so that process flow jumps to the external interrupt routine. It is now judged based on the timer value whether or not the external interrupt is an abnormal one. In other words, whether the interrupt is normal or abnormal can be judged based on the fact that, because the timer continues to count even after an overflow (i.e., it returns the counted value to zero and the starts to count again upon an overflow), the timer has a small value in case of the abnormal interrupt (while it has a value larger than a certain level in case of the normal interrupt. Such a state where [ZCP] is left at L, occurs when the AC cource power supplied to the controller is cut off by a relay (for prevention of danger), e.g., when a front cover of the reproducing machine is opened.

Finally, the drive signals for the lamp, fusing heater and the drum heater will be described below. The drive signals are all turned off upon each detection of [ZCP]. Immediately after that, the drive signals for the fusing and drum heaters are turned on in accordance with the controlled amount determined by the cycle 2*b*. The lamp drive sugnal is kept turned off until setting of the timer interrupt.

Hereinafter, the operation of the microcomputer IC5 will be described by referring to a general flow shown in FIG. 3*f*. Different types of parentheses appeared in the following description are defined as follows:

( ): Register, counter, flag

[ ]: Input/output signal

< >: Jump destination address

No parenthesis means names of subroutines, immediate data, parts or ports.

When the controller is powered on, an initial setting subroutine INITAL is first called to initialize the system, reset the respective ports, clear the stored content of RAM, make initial setting of a warm-up timer (for detecting a breakage of thermistors for the fusing and drum heaters), and to set the fusing heater temperature at the time of previous copying.

Then, a frequency decision subroutine CHKFRQ is called to judge whether the source frequency is 50 Hz or 60 Hz. A frequency flag (FO) is reset in case of 50 Hz but set in case of 60 Hz.

After completion of the subroutine CHKFRQ, a subroutine RESTEMP is called to preset the temperature control cycle counter, clear the registers for storing the sampling data of respective temperatures, and to enable the external interrupt.

After completion of the foregoing system initialization, the microcomputer now gets into a control routine.

First, it checks a zero-cross counter (ZCPCNT) and waits for the counted value to become an odd number. The counter (ZCPCNT) has been cleared during initialization of the system and, when the zero crossing pulse [ZCP] turns to L, it jumps to a zero-cross interrupt routine CINT where it is incremented. Namely, the microcomputer waits for that [ZCP] to turn to L after initialization of the system. When (ZCPCNT) becomes an odd number, an input read subroutine INPUT is called to read and store the display data selecting data and input signals.

After completion of the subroutine INPUT, it waits for setting of a timer flag (TF), i.e., it waits for the timer to get into an overflow. Upon an overflow of the timer, the timer flag is set to make a jump to a timer interrupt routine TMINT. In this routine, the lamp drive signal [LMPDRV] is turned on with the lamp light-up start signal [START] assuming L, while the signal [LMPDRV] is turned off with [START] assuming H. Returning from the timer interrupt routine to the main routine, the flag (TF) is now set so that a next lamp voltage sampling routine SPVOLT is called. The flag (TF) is reset at the time when it has been checked. In the subroutine SPVOLT, the instantaneous value of a signal analogous to the lamp voltage, the square of average value of the sampling data (AQ) is determined, and the integrated value of the resulting squares is stored in the RAM. The above operation will be repeated until [ZCP] turns to L.

The foregoing is the operation of the cycle 1. There will be described below the operation of the cycles 2*a* and 2*b*.

The subroutine INPUT is first called and a lamp voltage target value setting subroutine SPSET is then called. This subroutine sets the target value of the lamp voltage corresponding to the A/D-converted data (0–255) of voltage (0–2.5 V) at the input terminal A3 of the A/D converter 6, and to determine a timer increment value during soft start-up.

Next, a temperature sampling subroutine SPTEMP is called. In this subroutine, the temperatures of the fusing heater and drum heater are sampled and stored in the given memories. Thereafter, a lamp voltage effective value calculating subroutine CALRMS is called to determine an average square root of the square integrated value obtained in the cycle 1, i.e. effective value of the lamp voltage.

Next, a lamp voltage control subroutine PWM is called. In this subroutine, the timer increment value determined in the above is added to the phase angle timer register to increase the lamp voltage during soft start-up. After completion of soft start-up, the phase angle timer is updated in accordance with the effective value determined in the subroutine CALRMS to control the lamp voltage constant.

Next, a unit conversion subroutine CONDM is called. This is a routine for converting the digital value (given in digits) to a value expressed in practical units to permit immediate reading. Namely, the lamp voltage, phase angle timer and the temperature are converted to be expressed in Vrms, msec and °C, respectively. After such unit conversion, a BCD conversion subroutine CONBCD is called. In this subroutine, the data to be output to an indicator (not shown) is converted to a BCD (Binary Coded Decimal) signal.

Subsequently, a lamp light-up check subroutine CHKVLT is called. In this subroutine, the lamp voltage is checked, and [LAMPON] is turned on with the lamp lighting up but turned off with the lamp extinguished. Whether or not the lamp is lit up is judged based on that the effective value (RMS) of the sampled lamp voltage is larger or smaller than lamp-on decision data ONRMS. In other words, the lamp is regarded to be lit up if RMS≧ONRMS is met, but regarded to be distinguished if otherwise. Then if the lamp is kept lit up exceeding 10 sec, a system hazard flag (HAZARD) is set.

After completion of the subroutine CHKVLT, the system hazard flag (HAZARD) is checked. If it is set, the process flow jumps to <HAZON> to turn on a system hazard signal [HAZARD], control a safety relay and to cut off the power source of the controller, thereby avoiding occurrence of a danger condition. If the flag (HAZARD) is reset, the above operation is skipped over.

When the flag (HAZARD) is set, a zero crossing pulse anomaly flag (ZCPLO) is then checked. If it is set, the process flow jumps to <START> to return to the initial state. If the flag (ZCPLO) is reset, it further proceeds. Incidentally, setting/resetting of the flag (ZCPLO) is implemented by a zero crossing interrupt routine ZCINT.

Subsequently, the heater cycle counter (HETCNT) is checked and, if it is not at zero (i.e., in case of the cycle 2*a*), the process flows returns to <LBEGIN>. If the counter (HETCNT) is at zero (i.i., in case of the cycle 2*b*), it proceeds to the next temperature control routine. Herein, the counter (HETCNT) presets temperature control cycles HETIM (48) and is decremented every when calling the zero-cross interrupt subroutine ZCINT.

Further, when the counter (HETCNT) is at zero, a drum heater temperature control subroutine DRPID is first called. Up to this time, the drum heater temperature has been sampled 24 times and the integrated value has been stored in the RAM. The number of on-cycles of the drum heater is determined based on the average value of the integrated value thus stored.

Next, a fusing heater temperature target value setting subroutine SETEMP is called. In this subroutine, the integrated value of 24 sampling data of the fusing heater temperature is averaged. If the resulting average value corresponds to the first temperature control cycle (i.e., power-on), an amount of increase in the target temperature during the initial stage of copying is determined based on the average value. Then, the target value is set in accordance with a preheating signal [TEMPDN] and a roller rotating signal [TEMPUP].

After completion of the subroutine SETEMP, a fusing heater temperature control subroutine FUPID is now called. Herein, similarly to the above DRPID, the number of on-cycles of the fusing heater is determined based on the average value of the fusing heater temperature.

Next, a fusing heater duty fixing flag (FIXFUC) is checked and, if it is set at "1" (with duty fixed, i.e., the lamp lit-up), a fusing heater duty fixing subroutine RESFUC is called to fix the duty at 0 or 100%. If the flag (FIXFUC) is set at "0" (with the lamp extinguished), the foregoing operation is skipped over.

Next, a temperature check subroutine CHKTMP is called. In this subroutine, the temperatures of the fusing heater and drum are each checked and, if at least one of those temperature is abnormally raised up, a heater temperature anomaly flag (HETEMG) is set. Further, if at least one of thermistors for the fusing heater and the drum heater is broken, the flag (HETEMG) is set likewise. In other cases except for the above, the flag (HETEMG) is reset. Detection of abnormal temperature rising as well as breakage of the thermistors is made by comparison with the reference data preset and decision on the magnitude of the compared result (later described in detail).

After completion of the subroutine CHKTMP, the flag (HETEMG) is checked. If it is set, the process flow jumps to <HEMGON>, sets a system hazard flag (HAZARD), turns on a heater anomaly signal [HETEMG] and then jumps to <RUNTIM>. If the flag (HETEEMG) is reset (with the heater in a normal state), the signal [HETEMG] is turned off. Then, prereload is checked. More specifically, the fusing heaqer temperature (FUTEMP) is compared with prereload temperature decision data PRTEMP and, if (FUTEMP) ≧PRTEMP is resulted, a prereload signal (PRERLD) is turned on to inform the exterior of the fact that the fusing heater temperature has reached the prereload temperature. If (FUTEMP) <PRTEMP is resulted, the signal [PRERLD] is turned on to inform the exterior of the fact that the fusing heater temperature has not yet reached the prereload temperature.

Next, reload is checked. Similarly to check of prereload (FUTEMP) is compared with reload temperature decision data RLTEMP, and the signal [RELOAD] is turned on if (RETEMP) ≧PRTEMP but turned off if otherwise.

After completion of the foregoing check of the heater temperature, the process flow proceeds to <RUNTIM> and calls a subroutine RUNEXP. This subroutine counts the operating time of the controller and the number of light-up times of the lamp (i.e., the number of copies).

After completion of the foregoing process, the microcomputer returns to <HBEGIN> and then repeats the operations as mentioned above.

The respective interrupt service routines and subroutines will be described below.

Figure 3G:
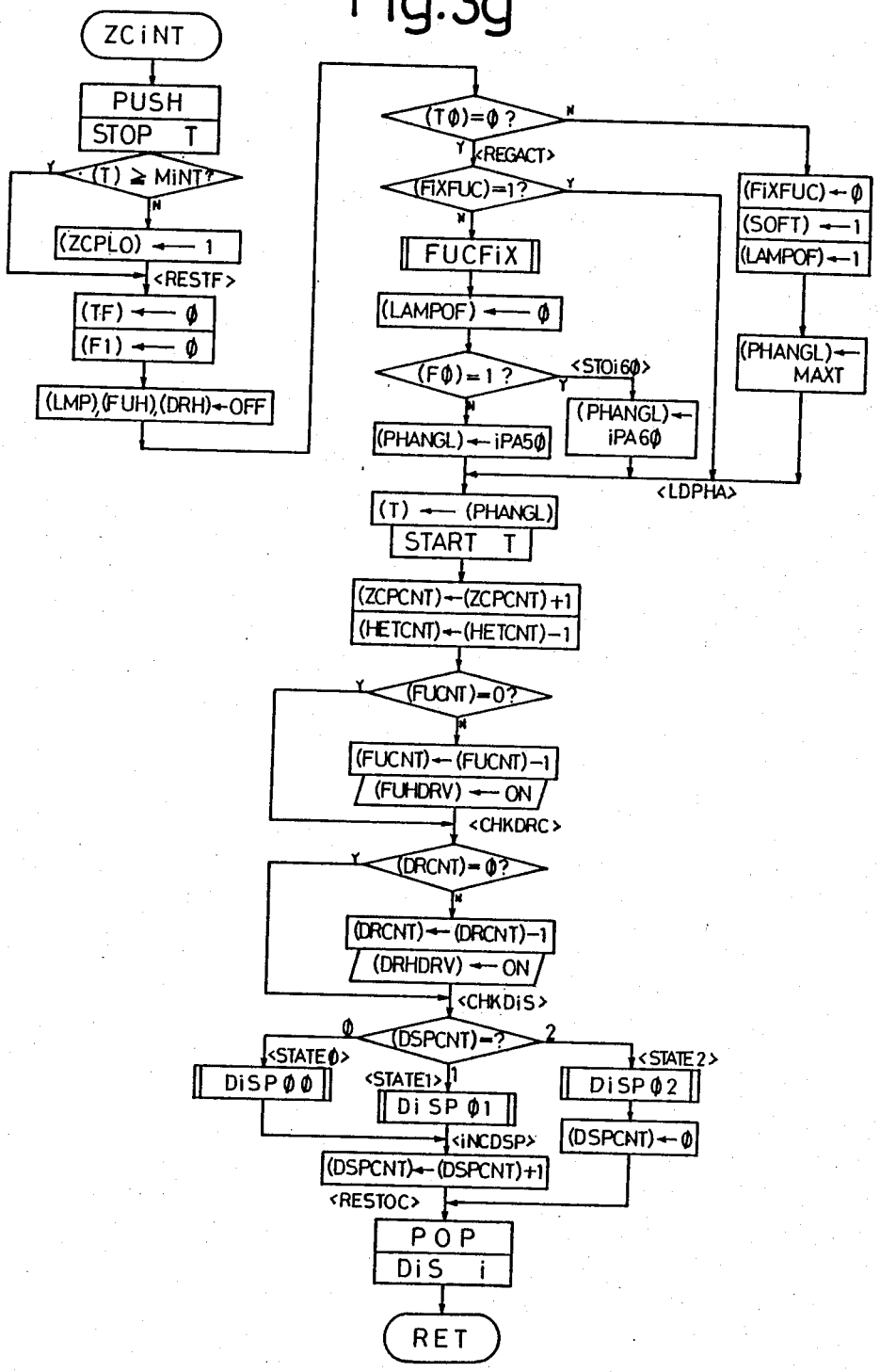

(1) ZCINT . . . refer to FIG. 3*g*

This interrupt service routine is called when the zero crossing pulse signal [ZCP] has turned to L, to make check of an abnormal interrupt, turn-off of the respective drive signals, start-up of the timer, processing for display, etc. First, upon setting of an interrupt, the timer is stopped and, if the value of the timer at that time is smaller than abnormal interrupt decision data MINT, that interrupt is regarded as an abnormal one to set an abnormal interrupt flag (ZCPLO). If the value of the timer is larger than MINT, the above operation is skipped over. Next, the timer flag (TF) and a zero crossing pulse anomaly flag (F1) are both reset. Then, the lamp drive signal [LMPDRV], fusing drive signal [FUHDRV] and the drum heater drive signal [DRHDRV] are turned off. Subsequently, the lamp light-up start signal [START] (T0 terminal) is checked and, if it is set at "1" (off), the microcomputer resets the fusing heater duty fixing flag (FIXFUC) and sets both a soft start-up flag (SOFT) and a lamp-off flag (LAMPOFF). Then, it loads MAXY (245: getting into an overlow after about 0.5 msec from start-up of the timer) into the phase angle timer register (PHANGL).

On the other hand, if the signal [START] is set at "0" (on), the flag (FIXFUC) is checked. If it is set at "0" (with the lamp starting to light up), the subroutine FUCFIX is called to fix the duty of the fusing heater at 0 or 100%. After completion of the above process, the flag (LAMPOF) is reset and initial phase angle timer data IPA50 or IPA60 is loaded into (PHANGL) in case of 50 Hz or 60 Hz. If the flag (FIXFUC) is set at "1", the above operation is skipped over.

Next, (PHANGL) is set as a timer which is then started. Subsequently, the zero-cross counter (ZCPCNT) is incremented and the heater cycle counter (HETCNT) is decremented. If the fusing heater on-cycle counter (FUCNT) is not at zero, this counter is decremented to turn on the signal [FUNDRV]. As for the drum heater, if the drum heater on-cycle counter (DRCNT) is not at zero, this counter is decremented likewise to turn on the signal [DRHDRV]. The display counter (DSPCNT) is then checked and, if it is at "0", the figure of the BCD-converted data (BCDHI) (BCDLO) in the digit of $10^0$ is displayed and the counter (DSPCNT) is decremented. If the counter (DSPCNT) is at 1, the figure of that data in the digit of $10^1$ is displayed and the counter (DSPCNT) is incremented. Furthermore, if the counter (DSPCNT) is at 2, the figure of that data in the digit of $10^2$ is displayed and the counter (DSPCNT) is cleared. Finally, any external interrupt is disabled.

Figure 3H:
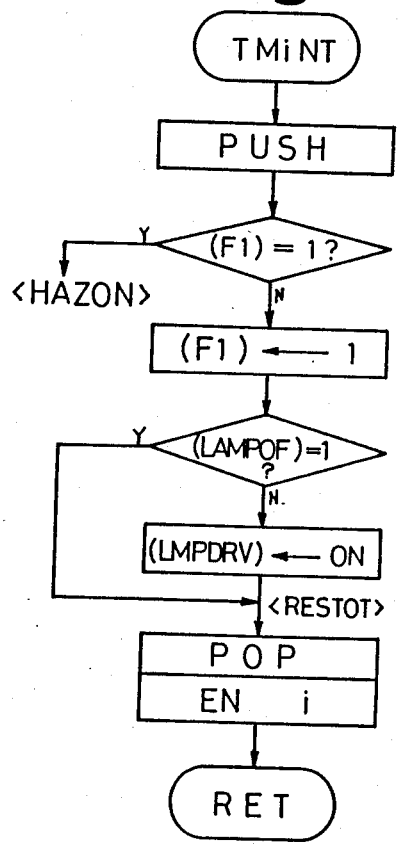

(2) TMINT . . . refer to FIG. 3*h*

This interrupt service routine is called upon an overflow of the timer, and serves to check the zero crossing pulse anomaly flag (F1) and turn on the lamp drive signal [LMPDRV]. Upon check, the flag (F1) is set to "1" if it has been set at "0". Then, if the flag (LAMPOF) is set at "0", the signal [LMPDRV] is turned on to supply the lamp voltage. Finally, an external interrupt is enabled. On the other hand, if the flag (F1) is set at "1", the process flow jumps to <HAZON> unconditionally to turn on the system hazard signal [HAZARD] and control the safety relay, thereby cutting off the power source of the controller.

Figure 3I:
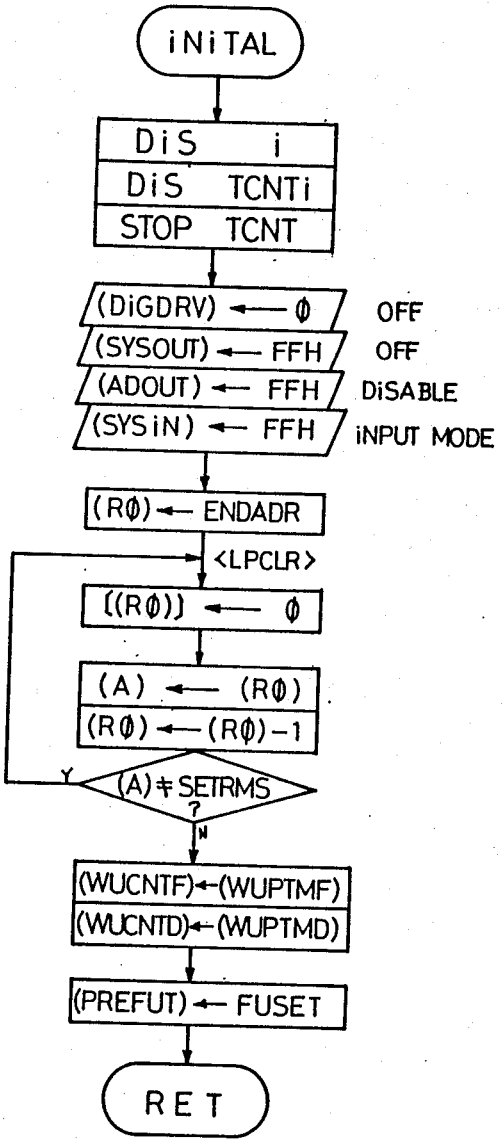

(3) INITAL . . . refer to FIG. 3*i*

This subroutine is adapted to initialize the system, reset the respective ports, clear the data RAM, make initial setting of the warm-up timer, and to set the fusing heater temperature at the time of previous gausi-copying. In initialization of the system, an external interrupt and a timer interrupt are both disabled and the timer is stopped. Resetting of the respective ports serves to turn off a display drive port DIGDRV, system output ports SYSOUT (lamp drive signal [LMPDRV], lamp on-state signal [LMPON], system hazard signal [HAZARD], fusing heater drive signal [FUHDRV], drum heater drive signal [DRHDRV], reload signal [RELOAD], heater anomaly signal [HETEMG], and prereload signal [PRERLD]), as well as a port ADCOUT (for expansion and A/D converter), and to set system input ports SYSIN into an input mode. In the initial setting of the warm-up timer, the fusing heater thermistor breakage detection timer data WUPTMF and the drum heater thermistor breakage detection timer data WUPTMD are set in warm-up timer counters (WUPCNTF) and (WUPCNTD), respectively. Finally, the fusing heater temperature at previous quasi-copying FUSET is set in a fusing heater temperature at previous copying resister (PREFUT).

Figure 3J:
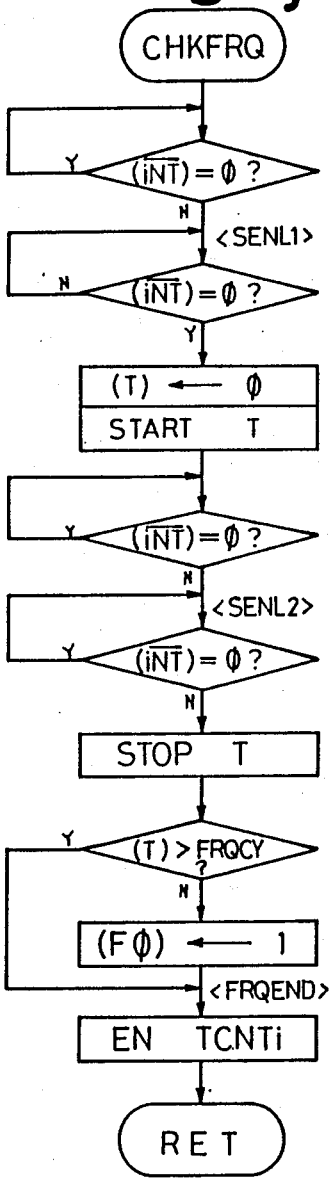

(4) CHKFRQ . . . refer to FIG. 3*j*

This subroutine is adapted to judge the source frequency. At the time when the zero crossing pulse signal [ZCP] turning to L is detected, the timer (T) is cleared and started. Then, when the next turning of [ZCP] to L is detected, the timer is stopped. Namely, the timer continues counting during a half wave of the source waveform. The counted value of the timer at that time is compared with the frequency decision data FRQCY.

The timer has a value of about 229 in case of 50 Hz and about 190 in case of 60 Hz. The frequency decision data FRQCY is set at an intermediate value of 210 therebetween, so that the source frequency is judged by comparison with the setting value. The source frequency is determined as 60 Hz as a result of the decision, the frequency flag (F0) is set. Finally, the timer interrupt is enabled.

Figure 3K:
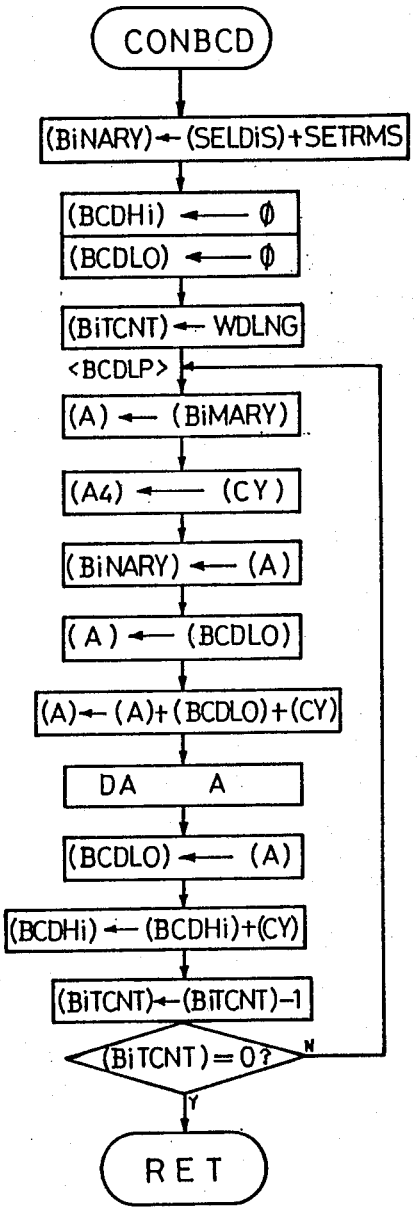

(5) CONBCD . . . refer to FIG. 3*k*

This subroutine is adapted to convert binary numerals corresponding to the display selection data (SELDIS) to decimal numerals, and then stores the latter in the register (BCDHI)(BCDLO).

Figure 3L:
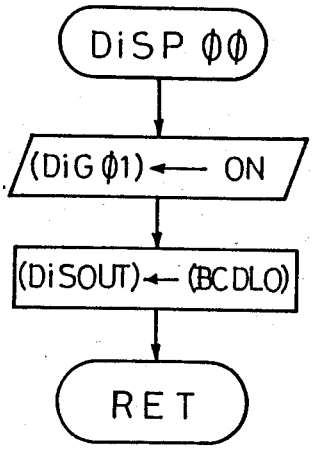

(6) DISP00 . . . refer to FIG. 3*l*

This subroutine is adapted to output the figure of the decimal numerals (BCDHI)(BCDLO) in the digit of $10^0$ to the indicator.

Figure 3N:
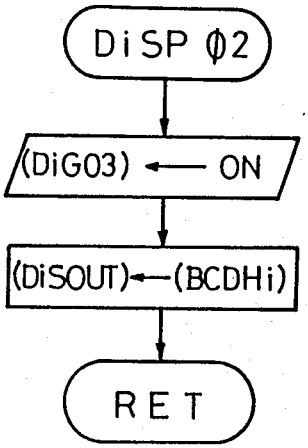
Figure 3M:
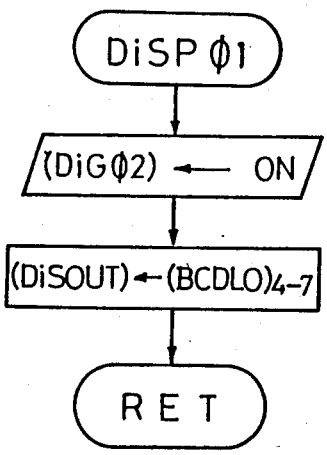

(7) DISP01 . . . refer to FIG. 3*m*

This subroutine is adapted to output the figure of the decimal numerals (BCDHI)(BCDLO) in the digit of $10^1$ to indicator.

(8) DISP02 . . . refer to FIG. 3*n*

This subroutine is adapted to output the figure of the decimal numerals (BCDHI)(BCDLO) in the digit of $10^2$ to the indicator.

Figure 3O:
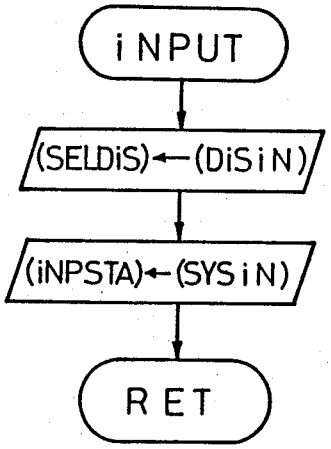

(9) INPUT . . . refer to FIG. 3*o*

This subroutine is adapted to read the display selection data (DISIN) and system input signals (SYSIN), and then stores them into a display selection buffer (SELDIS) and an input status buffer (INPTA), respectively.

Figure 3Q:
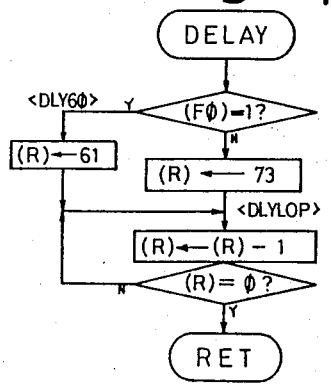
Figure 3P:
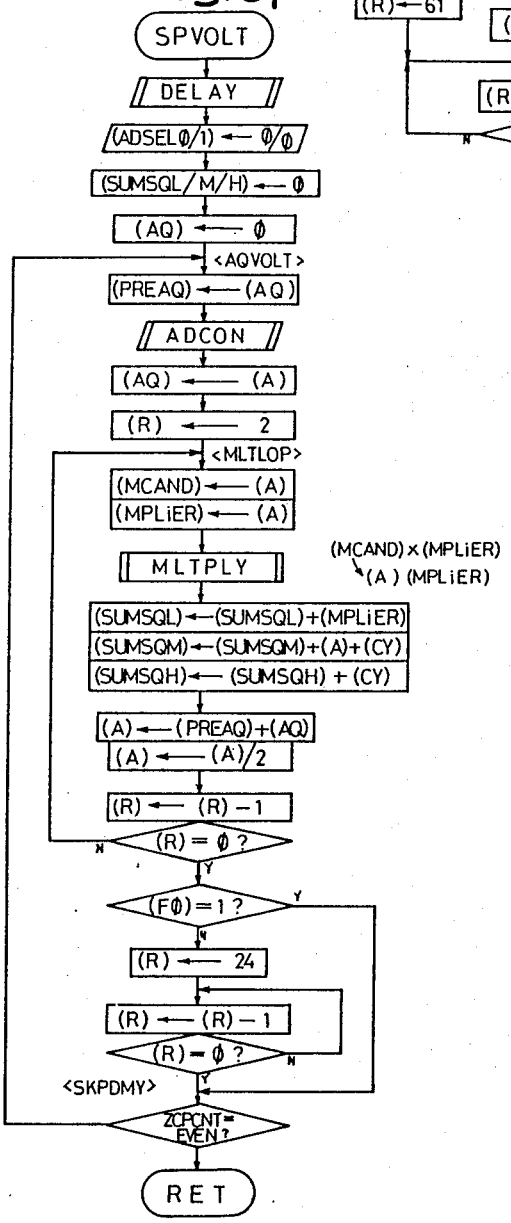

(10) SPVOLT . . . refer to FIG. 3*p*

This subroutine is adapted to perform sampling of the lamp voltage and square integration. First, the microcomputer calls a delay subroutine DELAY and waits for a half time of the sampling period. Then, the channel O(AO) of the A/D converter 6 is selected. Subsequently, square integration value registers (SUMSQH)(SUMSQM) & (SUMSQL) are cleared.

Next, the A/D conversion subroutine ADCON is called to sample the lamp voltage. The square of the resulted sampling data (AQ) is calculated and added to the registers (SUMSQH)(SUMSQM) & (SUMSQL). Further, the square of average value of the currently sampled data (AQ) and the previously sampled data (PREAQ) is calculated and also added to the registers (SUMSQH) (SUMSQM) & (SUMSQL).

Herein, in case of the first sampling, the data (PREAQ) is set at 0. In other words, the first average value becomes always a half of the first sampling data. Then, to make the sampling period reversely proportional to the source frequency, dummy processing waiting for a time is implemented in case of 50 Hz ((F0)=0). After completion of the above, the zero-cross counter (ZCPCNT) is checked and the above operation will be repeated until the counted value becomes an even number, i.e., until the next zero crossing time point.

(11) DELAY . . . refer to FIG. 3*q*

This subroutine is adapted to delay the sampling timing of the lamp voltage by a half of the sampling period as mentioned above.

Figure 3R:
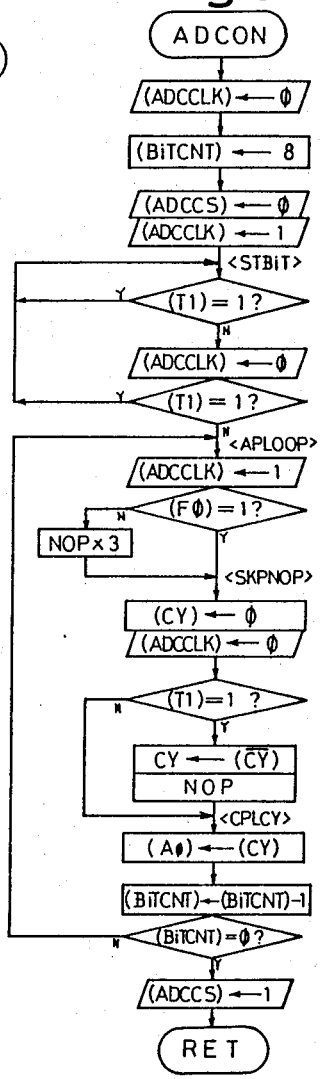

(12) ADCON . . . refer to FIG. 3*r*

This subroutine is adapted to implement the A/D conversion. Before calling of the subroutine, those channels (A0–A3 of the A/D converter 6) to which are applied the signals to undergo A/D conversion have been selected in advance. When this subroutine is called, A/D conversion is implemented. Further, to make and A/D conversion speed proportional to the source frequency, dummy processing waiting for a time is implemented in case of 50 Hz.

Figure 3S:
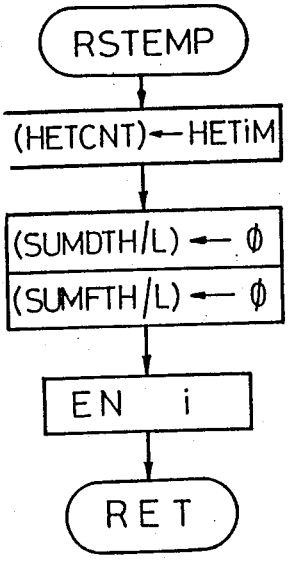

(13) RSTMP . . . refer to FIG. 3*s*

This subroutine is adapted to preset the heater cycle counter (HETCNT) and clear the integration registers for sampling data of the respective temperatures. The number of temperature control cycles HETIM(48) is preset in (HETCNT), and the integration registers (SUMFTH)(SUMFTL) and (SUMDTH)(SUMDTL) for sampling data of the fusing heater and drum heater temperatures are then cleared. Finally, an external interrupt is enabled.

Figure 3T:
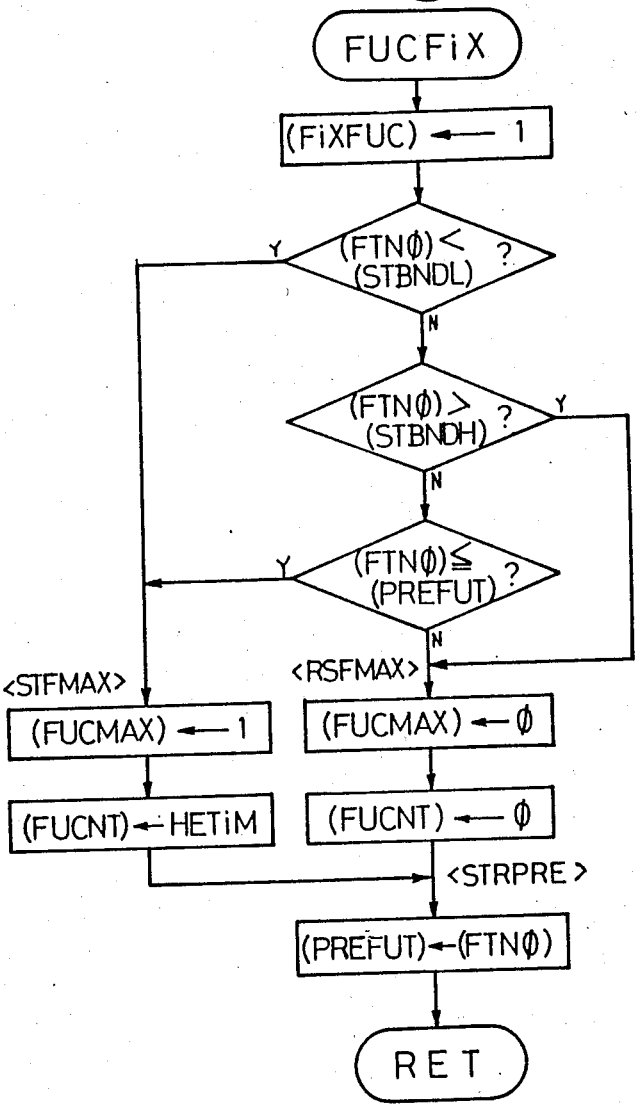

(14) FUCFIX . . . refer to FIG. 3*t*

This subroutine is called once when the lamp starts to light up, to fix the duty of the fusing heater. In this subroutine, the flag (FUCFIX) is first set so that this subroutine will not be called until the lamp starts to light up next time. Then, when the fusing heater temperature (FTNO) is lower than (STBNDL) and when it is lower than (STBMDH) as well as the fusing heater temperature at previous copying (PREFUT), a fusing heater duty decision flag (FUCMAX) is set and HETIM (duty 100%) is loaded into a fusing heater on-cycle counter (FUCNT).

If (FTNO) is otherwise, the flag (FUCMAX) is reset and 0 (duty 0%) is loaded into the counter (FUCNT). Finally, the current fusing heater temperature (FTNO) is loaded into (PREFUT).

Figure 3U:
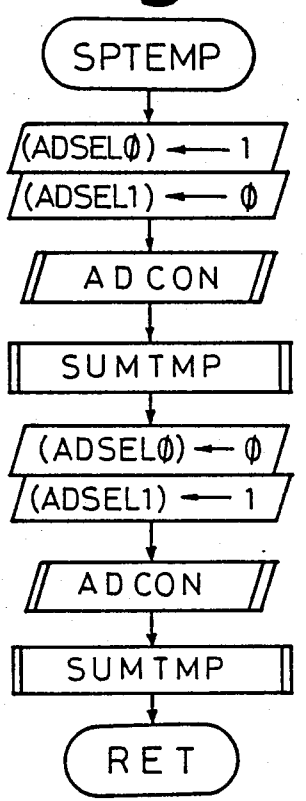

(15) SPTEMP . . . refer to FIG. 3*u*

This subroutine is adapted to sample the respective temperatures and integrate the sampled data. Namely, the temperatures of the fusing heater and the drum heater are sampled and added to the integration registers (SUMFTH)(SUMFTL) and (SUMDTH)(SUMDTL).

Figure 3V:
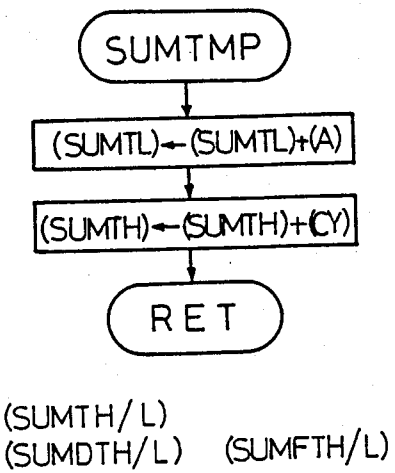

(16) SUMTMP . . . refer to FIG. 3*v*

This subroutine is called by SPTEMP to integrate the respective temperatures. Because the temperatures are sampled 24 times (per 2 cycles) during the temperature control cycles (48), 24 sampling data are integrated in total.

Figure 3W:
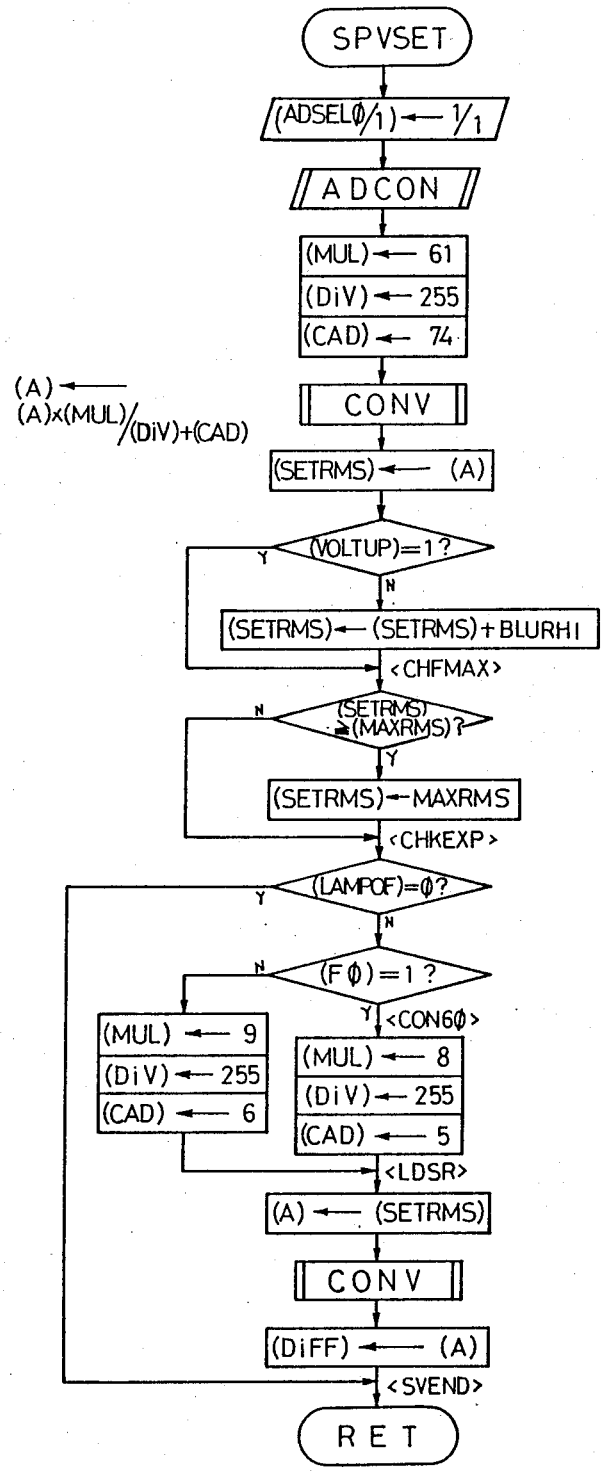

(17) SPVSET . . . refer to FIG. 3*w*

This subroutine is adapted to set the target value of the lamp voltage and determine the phase angle timer increment data for soft start-up. The microcomputer first selects the channel A3 of the A/D converter 6, A/D-converts the signal level applied thereto, and determines the target value (SETRMS) of the lamp voltage from the result (A) using the following equation:

$$(\text{SETRMS}) = (61/255) \times (\text{A}) + 74 \quad (1)$$

Then, if the blue extinguishing signal (VOLTUP) is at "0" (or active), an voltage-up value BLURMS is added to (SETRMS) to increase the target value. If the added result (SETRMS) exceeds MAXRMS (84 Vrms), (SETRMS) is restrained to MAXRMS.

Next, the lamp-off flag (LAMPOF) is checked and, if it is at "1" (with the lamp turned off), the phase angle timer increment value (DIFF) for soft start-up is calculated from the above (SETRMS) using the following equation:

In case of 50 Hz;

$$(\text{DIFF}) = (9/255) \times (\text{SETRMS}) + 6 \quad (2)$$

In case of 60 Hz;

$$(\text{DIFF}) = (8/255) \times (\text{SETRMS}) + 5 \quad (3)$$

If the flag (LAMPOF) is at "0" (with the lamp turned on), the foregoing operation is skipped over.

Figure 3Y:
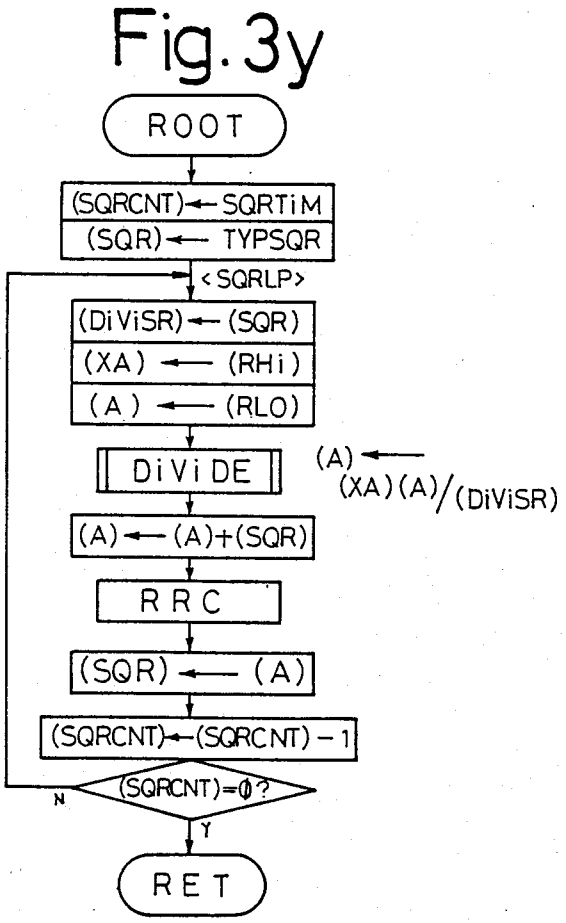
Figure 3X:
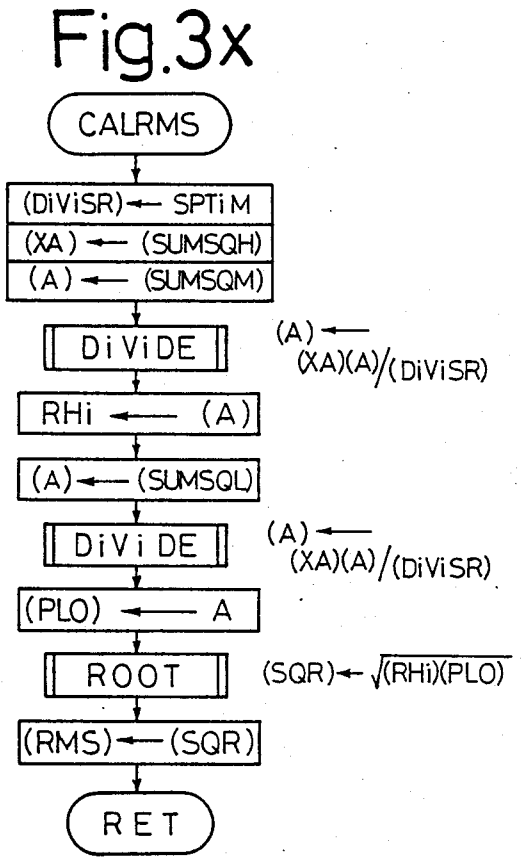

(18) CALRMS . . . refer to FIG. 3*x*

This subroutine is adapted to calculate the effective value of the lamp voltage. The square integration values of lamp voltage (SUMSQH)(SUMSQM) & (SUMSQL) obtained previously is divided by the number of sampling times SPTIM (two times the number of possible sampling times for each cycle) to obtain the average value (RHI)(RLO). Then, the square root of that average value, i.e., the effective value (RMS) of the lamp voltage is calculated.

(19) ROOT . . . refer to FIG. 3*y*

This subroutine is called by CALRMS to calculate the square root of the data (RHI)(RLO).

Figure 3Z:
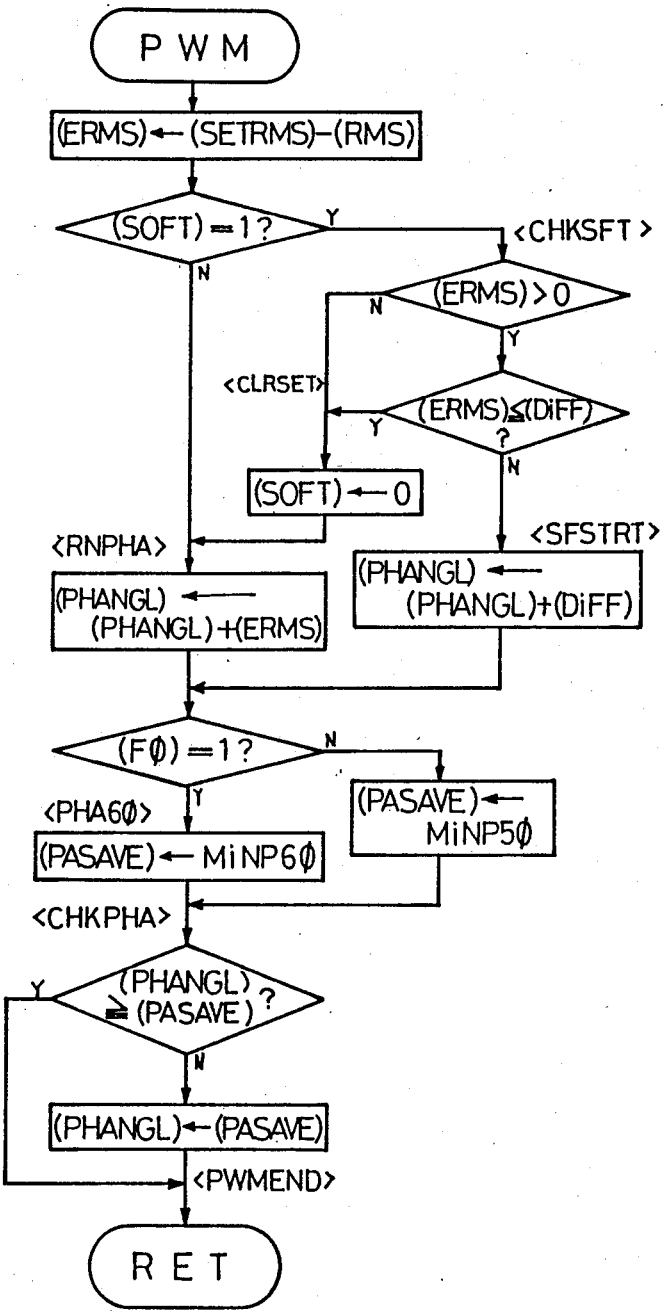

(20) PWM . . . refer to FIG. 3*z*

This subroutine is adapted to update the setting value of the lamp voltage phase angle timer (PHANGL). First, the difference (ERMS) between the target value (SETRMS) of the lamp voltage and the effective value (RMS) of the actual lamp voltage is obtained. If the soft start-up flag (SOFT) is at "1" (during soft start-up), (ERMS) is checked and, if it is negative (in case of exceeding the target value) or within the phase angle timer increment value (DIFF), the flag (SOFT) is reset (soft start-up is ended) and the value of (ERMS) is added to (PHANGL) to update the content of (PHANGL). Further, when the updated (PHANGL) is smaller than a phase angle timer lower limit value (MINP50 for 50 Hz, MINP60 for 60 Hz), the phase angle timer lower limit value is stored in (PHANGL).

Figure 4A:
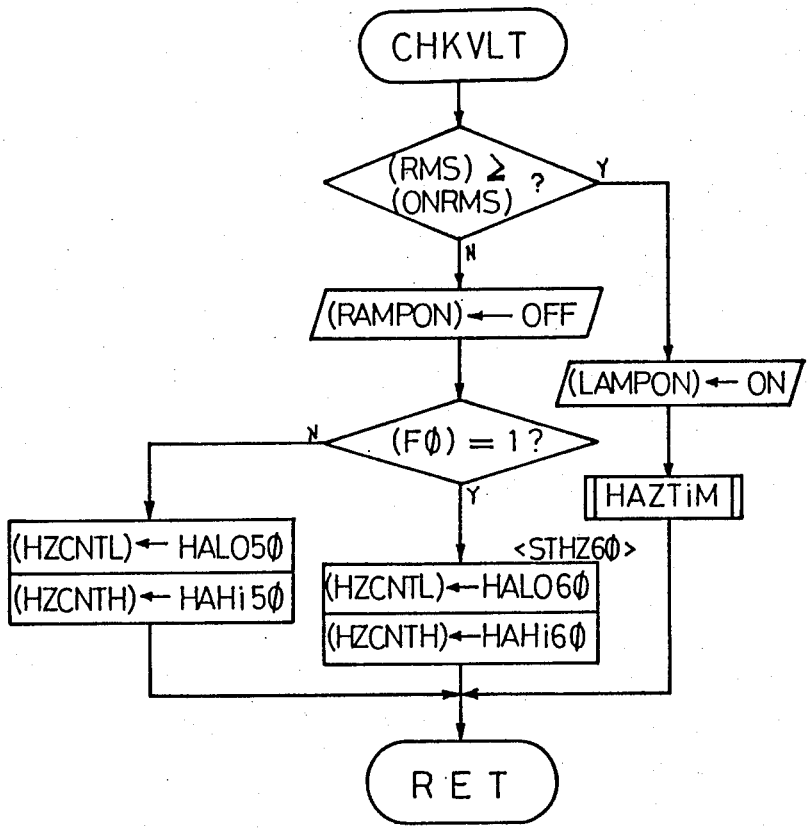

(21) CHKVLT . . . refer to FIG. 4*a*

This subroutine is adapted to inform the exterior of a lit-up state of the lamp and check a lamp lighting-up time. If the lamp voltage (RMS) is samller than the lamp light-up decision data ONRMS, the lamp-on signal [LAMPON] is turned off to inform the exterior of the fact that the lamp is extinguished. Then, the system hazard counters (HZCNTH)+(HZCNTL) are preset (to the values of HAHI50, HAL050 for 50 Hz or HAHI60, HALO60 for 60 Hz).

On the other hand, if (RMS) is equal to or larger than ONRMS, the signal [LAMPON] is turned on to inform the exterior of the fact that the lamp is lit up. Then, the subroutine HAZTIM is called to count a lamp lighting-up time.

Figure 4B:
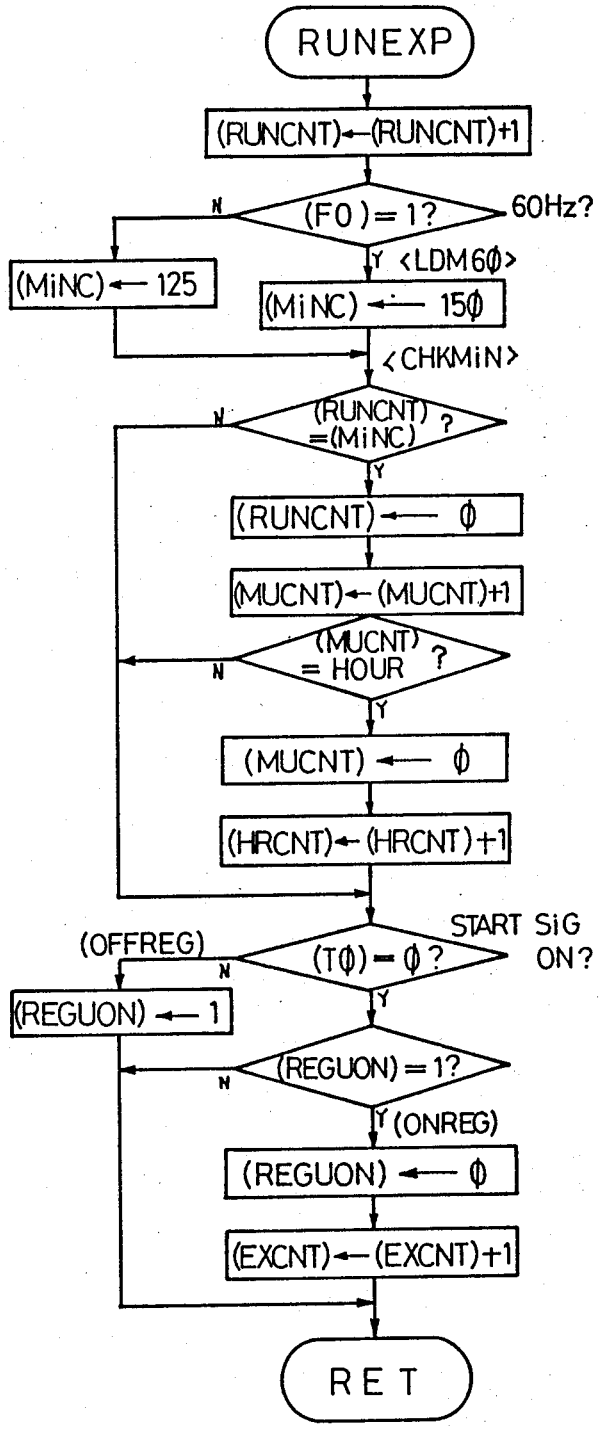

(22) RUNEXP . . . refer to FIG. 4*b*

This subroutine is adapted to count a running time of the controller and the number of light-up times of the lamp. Upon power-on, a run counter (RUNCNT), minute counter (MUCNT) and an hour counter (HRCNT) have been cleared. For each calling of this subroutine, the counter (RUNCNT) is incremented. When the incremented value becomes equal to minute decision data (MINC) (125 for 50 Hz, 150 for 60 Hz), the counter (RUNCNT) is reset and the counter (MUCNT) is now incremented. Then, when the value of the counter (MUCNT) becomes equal to hour decision data (60, i.e., the lapse of an hour), it is cleared and the hour counter (HRNT) is now incremented.

Next, when the lamp light-up start signal [START] is changed from turn-off to turn-on, a lamp light-up counter (EXPCNT) is incremented.

Figure 4C:
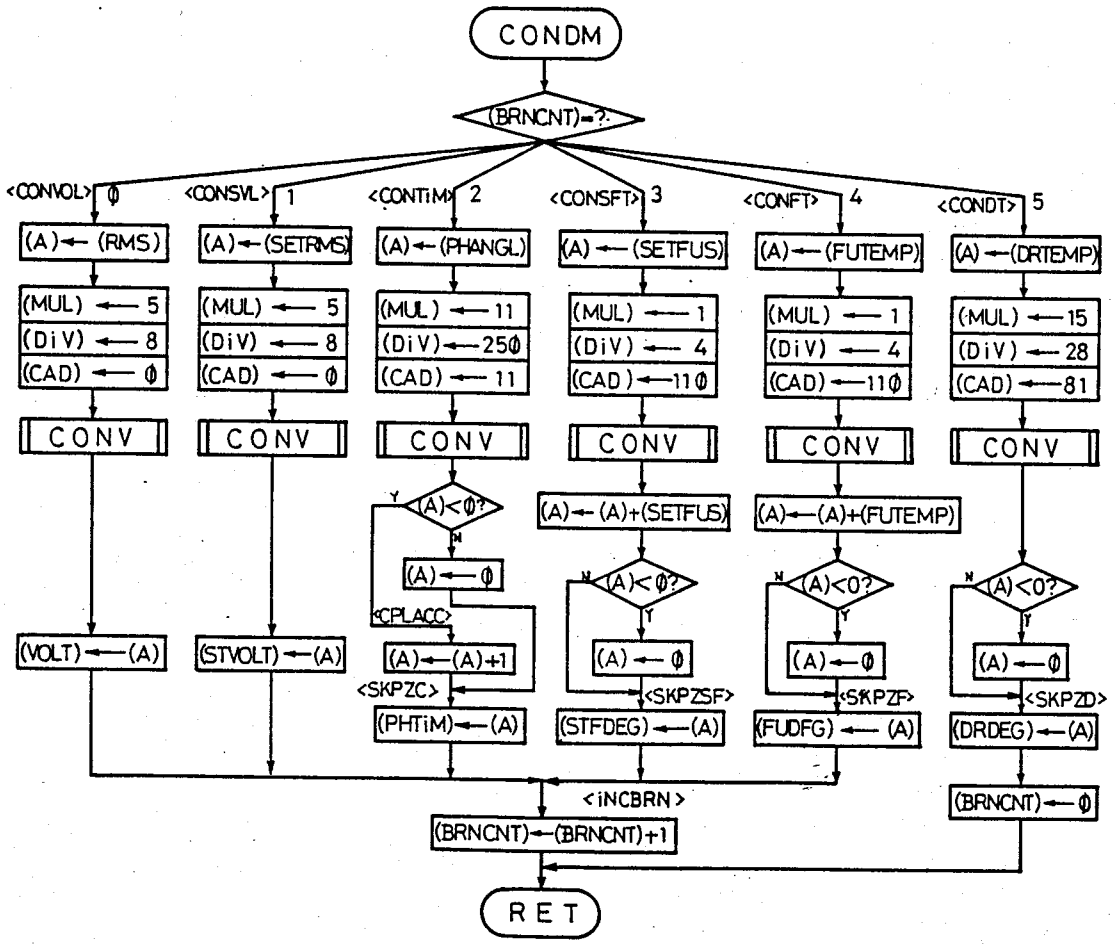
Figure 4D:
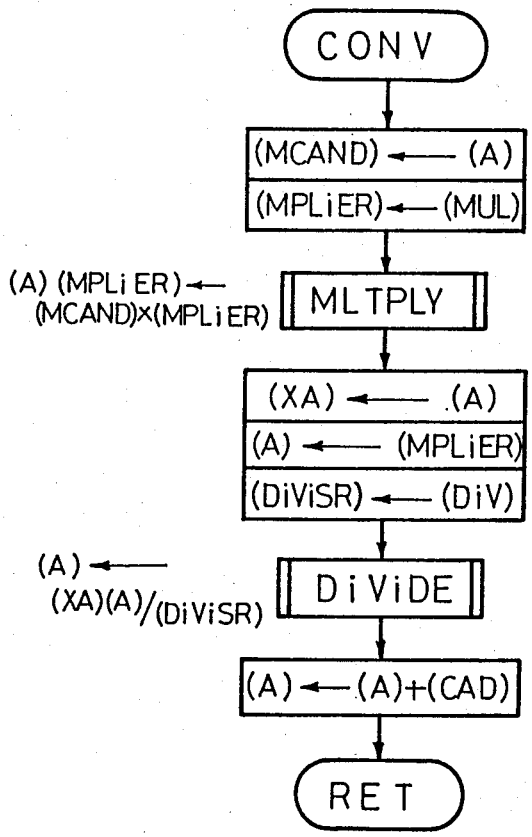

(23) CONDM . . . refer to FIG. 4*c*

This subroutine is adapted to convert the units of the digital data for immediate reading of various data on the indicator. Namely, the voltage, phase angle and the temperature data are converted to the data expressed in Vrms, msec and °C., respectively. The relationships between the digital data before the unit conversion, such as the lamp voltage effective value (RMS), lamp voltage target value (SETRMS), lamp voltage phase angle timer (PHANGL), fusing heater temperature target value (SETFUS), fusing heater temperature (FUTEMP) and the drum heater temperature (DRTEMP), and the correspondingly unit-converted data, such as (VOLT), (STVOLT), (PHTIM), (STFDEG), (FUDEG) and (DRDEFGO), are as follows:

$$(VOLT)=(5/8)\times(RMS) \quad (4)$$

$$(STVOLT)=(5/8)\times(SETRMS) \quad (5)$$

$$(PHTIM)=(11/2509)\times(PHANGL)-11 \quad (6)$$

$$(SETDEG)=(1/4)\times(SETFUS)-110 \quad (7)$$

$$(FUDEG)=(1/4)\times(FUTEMP)-110 \quad (8)$$

$$(DRDEG)=(15/28)\times(DRTEMP)-81 \quad (9)$$

Because there are six types of data to be converted in their units, a hexadic counter (BRNCNT) is provided to convert the data (RMS), (SETRMS), (PHANGL), (SETFUS), (FUTEMP) and (DRTEMP) when the content thereof equals to 0, 1, 2, 3, 4 and 5, respectively.

Figure 4E:
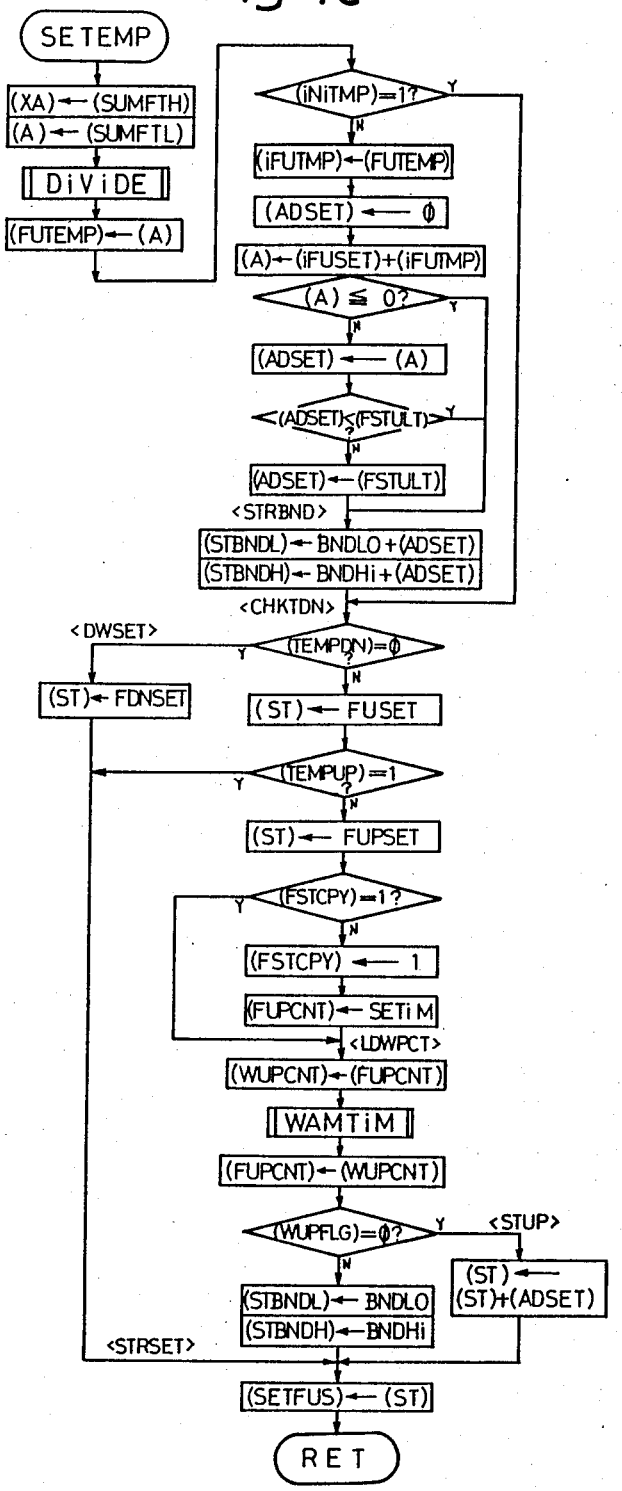

(25) SETEMP . . . refer to FIG. 4*e*

This subroutine is adapted to obtain the average value of the fusing heater temperature (during the temperature control cycle) and to set the target value of the fusing heater temperature. First, the average value of fusing heater temperature (FUTEMP) is calculated. Then, if this (FUTEMP) is of temperature data at the time of power-on, the data is stored in an initial fusing heater temperature register (IFUTMP) and compared with the temperature-up decision data at initial copying IFUSET. If (IFUTEMP)<IFUSET is resulted, the difference therebetween is stored in an up-resister at initial copying (ADSET). But, if the difference exceeds a temperature-up upper limit value FSTULT, FSTULT is stored in (ADSET). Then, BNDHI+(ADSET) and BNDLO+(ADSET) are stored in (STBNDH) and (STBNDL), respectively.

Next, the preheating signal [TEMPDN] is checked and, if it is turned on, the preheating temperature data FDNSET is set in a fusing heater temperature target value register (SETFUS). If the signal [TEMPDN] is turned off, the roller rotating signal [TEMPUP] is checked and, if [TEMPUP] is turned off (stand-by mode), the stand-by temperature data FUSET is set in (SETFUS). If the signal [TEMPDN] is turned on, the target value is increased up (about 5 sec) until the fusing heater temperature-up counter at initial copying FUPCNT) has become zero. Namely, FUPSET+(ADSET) is set in (SETFUS). After that, FUPSET is set in (SETFUS) and then BNDHI and BNDLO are stored in (STBNDH) and (STBNDL), respectively.

Figure 4F:
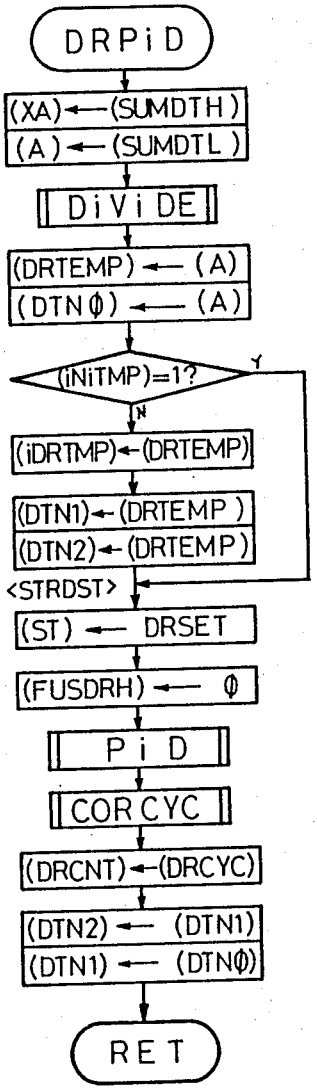

(26) DRPID . . . refer to FIG. 4*f*

This subroutine is adapted to update the number of on-cycles (duty) of the drum heater. First, the average value of drum heater temperature (DRTEMP) is calculated and stored in a current temperature register (FTNO). In case of the temperature data at power-on, (DRTEMP) is stored in an initial drum heater temperature register (IDRTMP) and further stored in previous and two times before temperature registers (DTN1) and (DTN2).

Next, the subroutine PID is called to update and correct the number of on-cycles of drum heater. Finally, (DTN1) and (DTN0) are stored in (DTN2) and (DTN1), respectively.

Figure 4G:
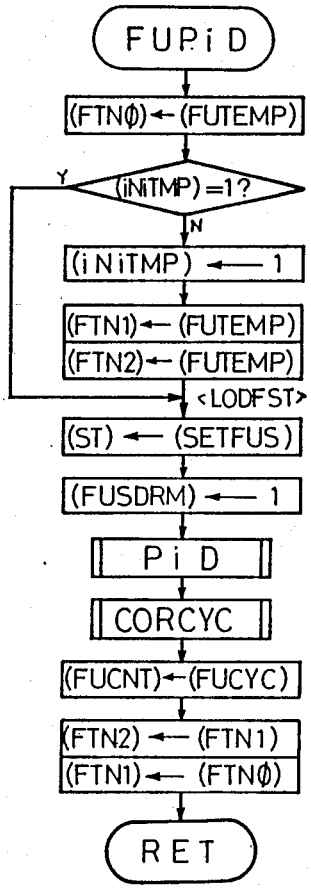

(27) FUPID . . . refer to FIG. 4*g*

This subroutine is adapted to update the number of on-cycles (duty) of the fusing heater. First, (FUTEMP) is stored in a current temperature register (FTN0). At the time of power-on, (FUTEMP) is further stored in previous and two times before temperature registers (FTN1) and (FTN2).

Then, PID is called to obtain a variation (EM) in the number of on-cycles of fusing heater (FUCYC), and CORCYC is called to update and correct (FUCYC). Finally, (FTN1) and (FTN0) are stored in (FTN2) and (FTN1), respectively.

Figure 4H:
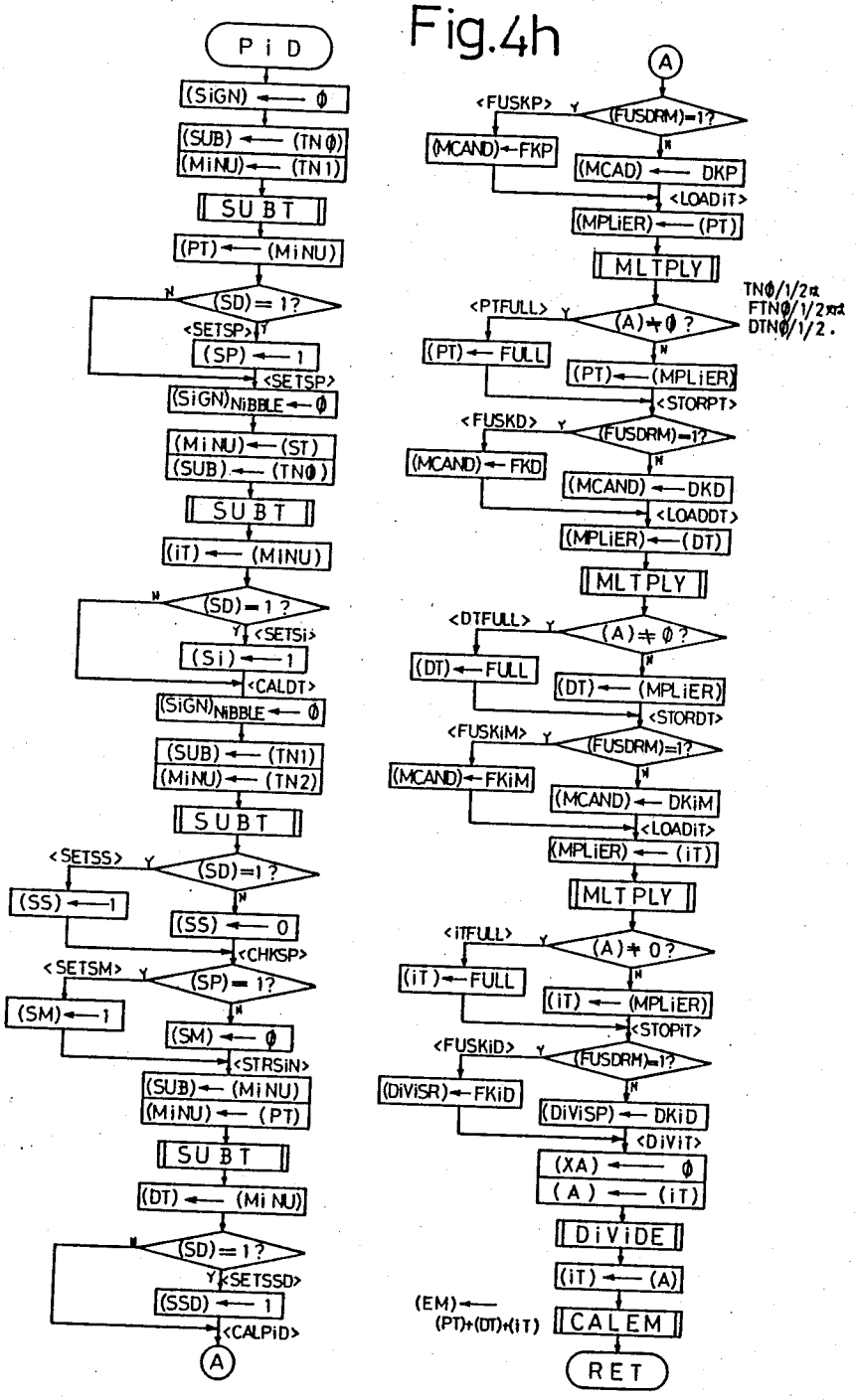

(28) PID . . . refer to FIG. 4*h*

This subroutine is called by DRPID or FUPID to obtain a variation (EM) in the number of on-cycles of the drum heater or fusing heater. (EM) is calculated based on the following equations:

$$(PT)=(TN1)-(TN0) \quad (10)$$

$$(IT)=(ST)-(TN0) \quad (11)$$

$$(DT)=(PT)-[(TN2)-(TN1)] \quad (12)$$

$$(EM)=KP\times(PT)+(KIM/KID)\times(IT)+(KD)\times(DT) \quad (13)$$

where (TN0): current temperature of drum or fusing heater (TN1): previous temperature of drum or fusing heater (TN2): two times before temperature of drum or fusing heater KP, KIM, KID and KD are constants determined by characteristics of drum or fusing heater.

Figure 4K:
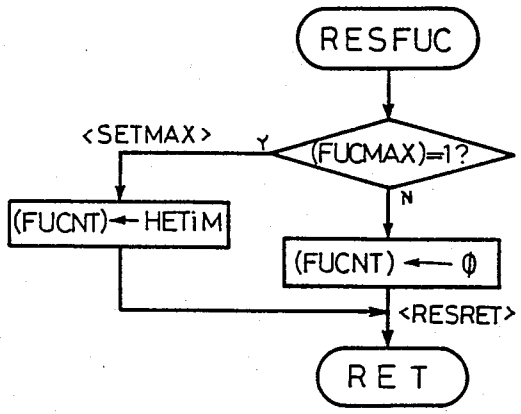
Figure 4I:
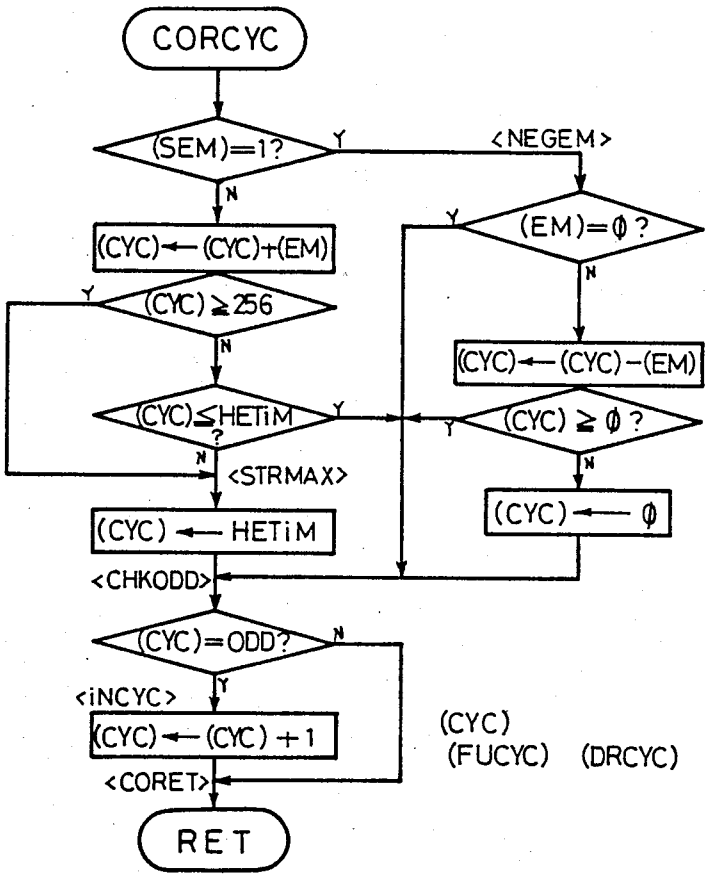

(29) CORCYC . . . refer to FIG. 4*i*

This subroutine is called DRPID or FUPID to update and correct (DRCYC) or (FUCYC). First, (EM) obtained in PID is added to the number of on-cycles (or (FUCYC) when called by DRPID) for update thereof. The updated result is corrected to zero if it has become negative, and to HETIM (duty 100%) if it has exceeded HETIM. Further, if the updated result is an odd number, it is added with one to be changed into an even number.

Figure 4J:
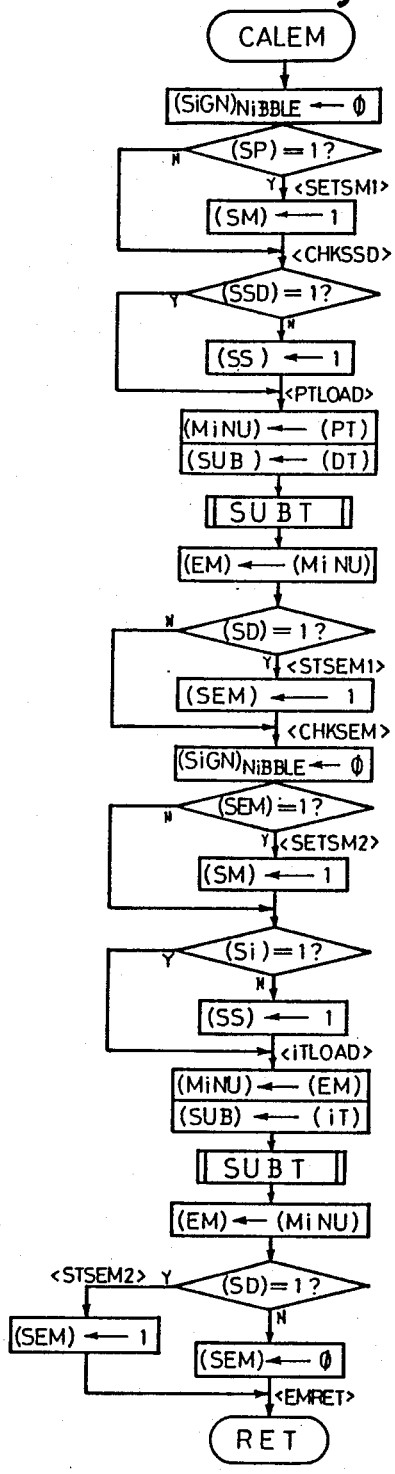
Figure 41:
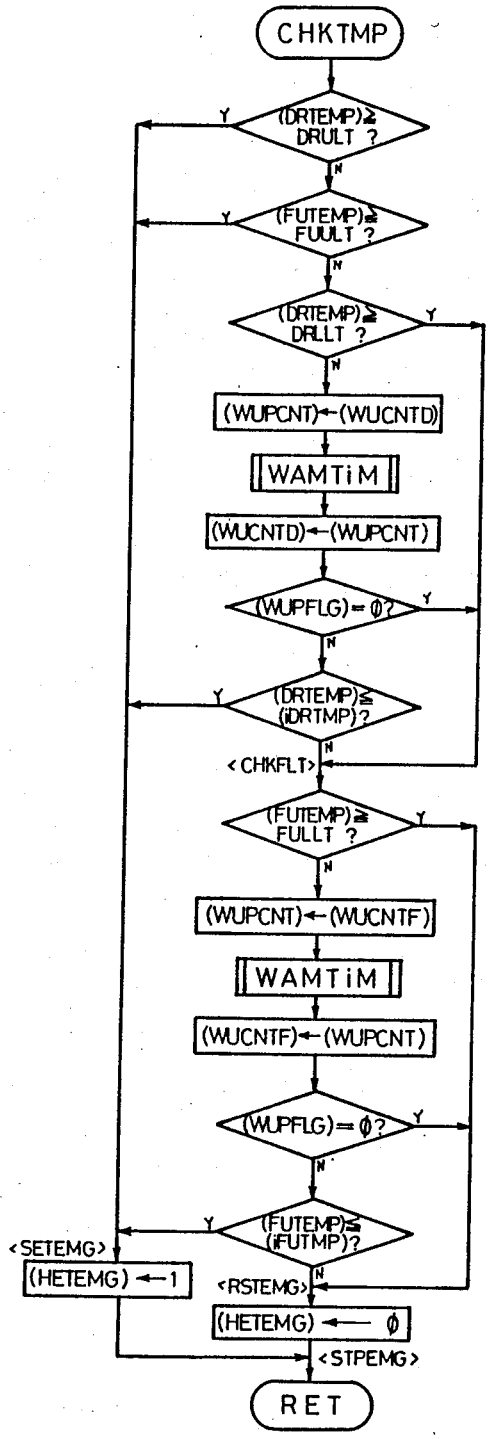

(30) CALEM . . . refer to FIG. 4*j*

This subroutine is called by PID to add the multiplied results of respective terms in the above equation (13), to thereby calculate (EM).

(31) RESFUC . . . refer to FIG. 4*k*

This subroutine is called when the fusing heater duty fixing flag (FIXFUC) is at "1" (copy mode), to store HETIM (duty 100%) in the fusing heater on-cycle counter (FUCNT) if the fusing heater duty decision flag (FUCMAX) is at "1", and 0 in (FUCNT) if (FUCMAX) is at "0", respectively.

(32) CHKTMP . . . refer to FIG. 4*l*

This subroutine is adapted to check the temperatures of the fusing heater and drum heater, and then judge whether or not the temperatures have been raised abnormally or thermistors have been broken. If the drum heater temperature (DRTEMP) is equal to or higher than a drum temperature upper limit value DRULT, this is regarded as an abnormal rise in the drum heater temperature and the heater anomaly flag (HETEMG) is set. If otherwise, the fusing heater temperature (FUTEMP) is checked and, if it is equal to or higher than a fusing heater temperature upper limit value FUULT, this is regarded to be as an abnormal rise in the fusing heater temperature and the flag (HETEMG) is set.

If the temperatures are both lower than the corresponding upper limit values, (DRTEMP) is compared with a drum heater temperature lower limit value DRLLT. Then, if (DRTEMP) is lower than DRLLT, the drum heater warm-up counter (WUCNTD) is decremented. If (DRTEMP) is kept lower than DRLLT and also equal to or lower than (IDRTMP) even after the counter (WUCNTD) has become zero (i.e., the lapse of 42 sec for 50 Hz, 35 sec for 60 Hz), the drum heater thermistor is regarded to be broken and (HETEMG) is set. Likewise, (FUTEMP) is compared with a fusing heater temperature lower limit value FULLT. Then, if (FUTEMP) is lower than FULLT, the fusing heater warm-up counter (WUNCNTF) is decremented. If (FUTEMP) is kept lower than FULLT and also equal to or lower than (IFUTMP) even after the counter (WUCNTF) has become zero (i.e., the lapse of 18 sec for 50 Hz, 15 sec for 60 Hz), the fusing heater thermistor is regarded to be broken and the flag (HETEMG) is set. In other cases except for the above, the heater system is regarded to be normal and the flag (HETEMG) is reset.

Figure 4N:
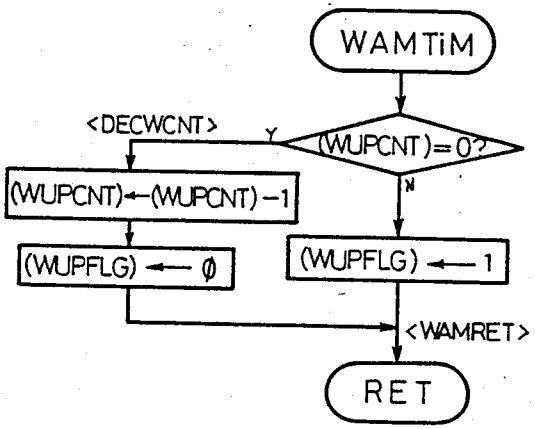
Figure 4M:
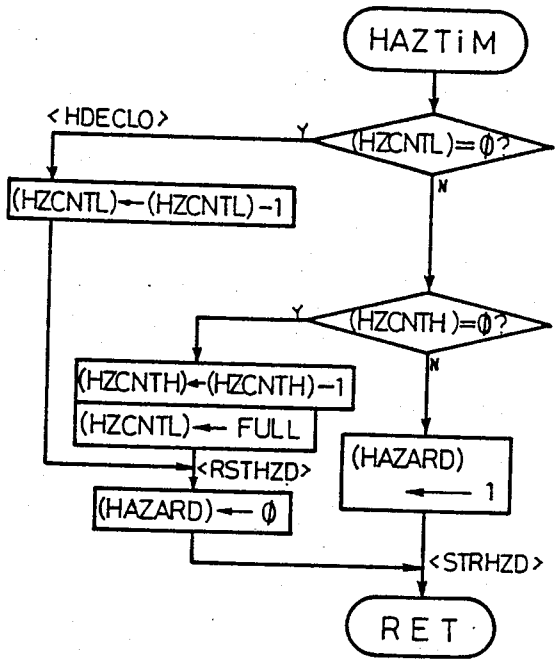
Figure 40:
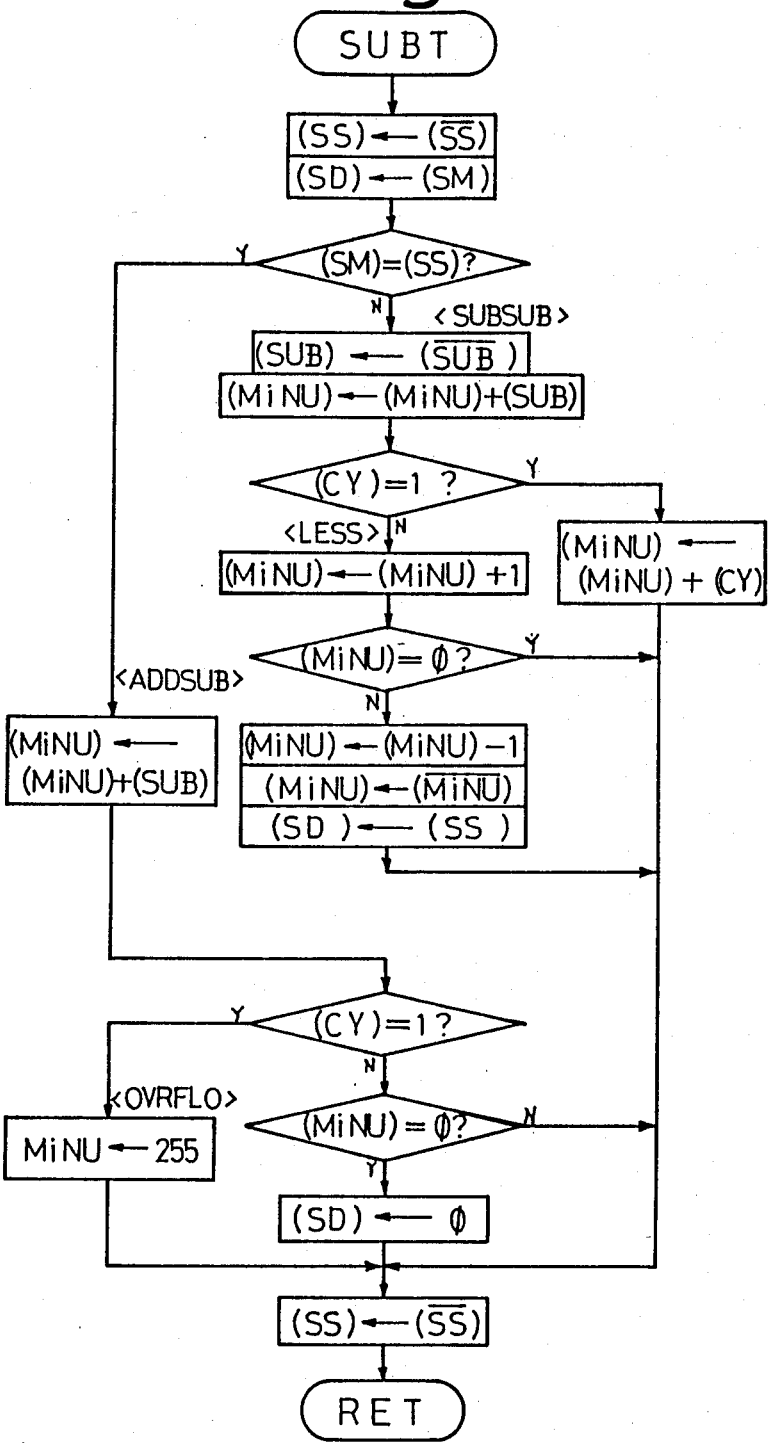

(33) HAZTIM . . . refer to FIG. 4*m*

This subroutine is adapted to decrement the system hazard counter (HAZCNTH)(HAZCNTL) and set the system hazard flag (HAZARD) when that counter has become zero, i.e., when the lamp continues to light up for 10 seconds.

(34) WAMTIM . . . refer to FIG. 4*n*

This subroutine is employed as a fusing heater temperature target value up-timer at the time of initial copying and a thermistor breakage detection timer for the drum heater and fusing heater. After the lapse of the setting time, the warm-up flag (WUPFLG) is set.

(35) SUBT . . . refer to FIG. 4*o*

This subroutine is a subtraction routine.

Figure 4P:
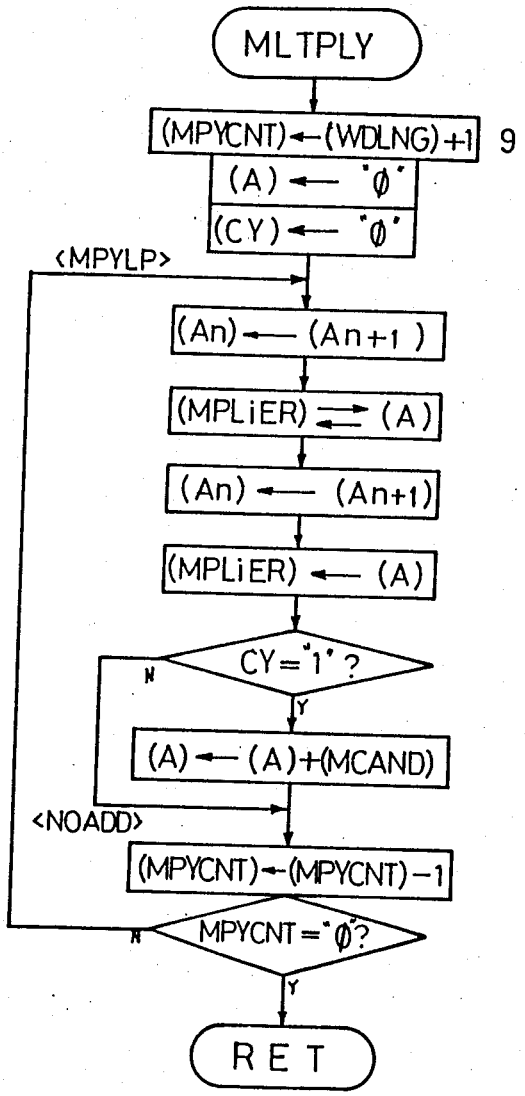

(36) MLTPLY . . . refer to FIG. 4*p*

This subroutine is a multiplication routine.

Figure 4Q:
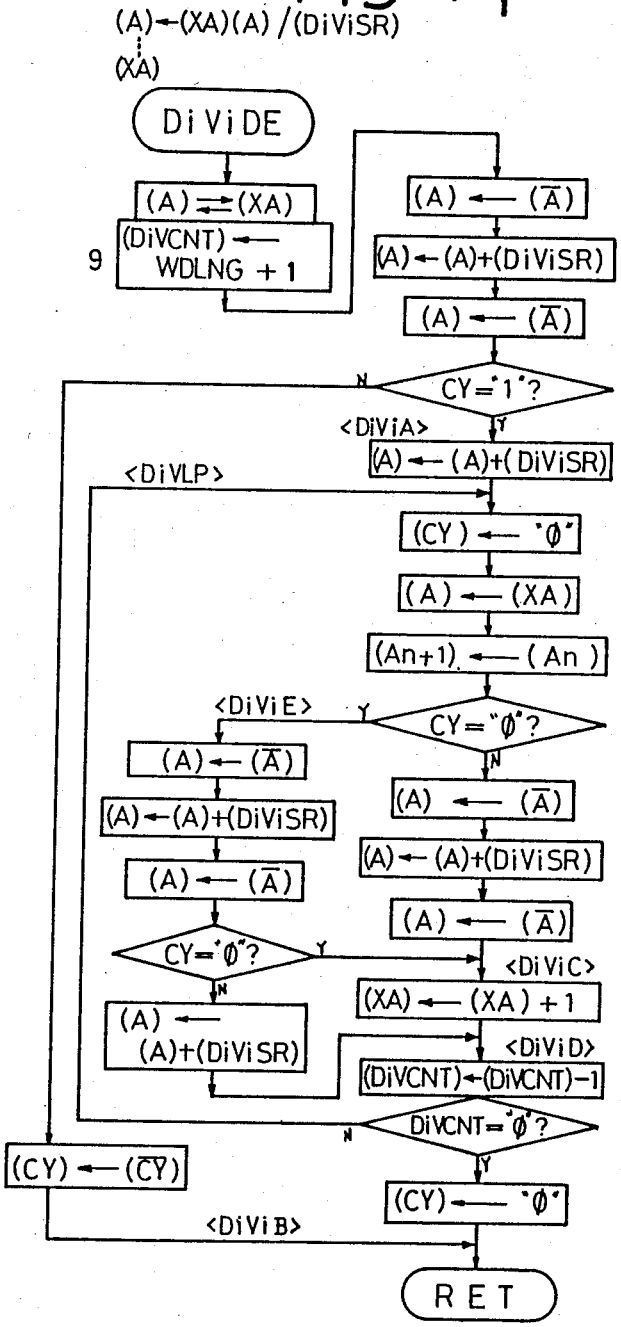

(37) DIVIDE . . . refer to FIG. 4*q*

This subroutine is a division routine.

As described in the above, according to the present invention, since the time required for implementing once the control operation to maintain the load power is made smaller, it becomes possible to control even fast varying disturbances so that they may be promptly compensated.

What is claimed is:

1. An alternating current load power controller comprising:

switching means for controlling application of an alternating current voltage applied from an alternating current power source to a load, said power source having a predetermined waveform, said waveform having first and second half cycles;

first detection means for generating and electric signal corresponding to said alternating current voltage applied to said load;

analog-to-digital conversion means for converting the signal from said first detection means from analog to digital data;

second detection means for generating a synchronizing signal in synchronism with the waveform of said alternating current power source; and electronic control means for alternately (1) sampling said digital data of the signal from said analog-to-digital conversion means during a first half cycle of the waveform, and in response to the sampling, calculating a square of said sampled digital form of the signal, (2) calculating the square-root of data resulting from calculating the square of said sampled digital data during a second half cycle of said waveform to derive a square root value, said electronic control means comparing the derived square root value with a preset control value to derive a control signal, said control signal being used to set a switching phase of said switching means, said switching means being controlled in timed relationship with said switching phase and the synchronizing signal from said second detection means.

2. The alternating current load power controller according to claim 1, wherein said electronic control means further comprises means for calculating the square of digital data sampled over several cycles and for averaging the same.

3. The alternating current load power controller according to claim 1, wherein said electronic control means starts the process of sampling the signal from said first detection means when said alternating current voltage is applied to said load.

4. The alternating current load power controller according to claim 1, wherein said electronic control means adds or subtracts a predetermined value corresponding to said derived square root value and said preset control value to or from said control signal.

5. The alternating current load power controller according to claim 1, wherein said electronic control means repeatedly adjusts said control signal by a predetermined adjustment value, until just before the time when the result of said square root calculation exceeds said preset control value.

6. An alternating current load power controller according to claim 5, wherein said electronic control means judges whether or not the result of said square root calculation exceeds said preset control value, by comparing the difference between the result of said square root calculation and said preset control value with said predetermined adjustment value.

7. An alternating current load power controller according to claim 1, wherein said electronic control means sets said control value in accordance with information from analog level setting means connected to an input terminal of said analog/digital conversion means.

8. An alternating current load power controller comprising:

switching means for controlling application of an alternating current voltage applied from an alternating current power source to a load, said power source having a predetermined waveform, said waveform having first and second half cycles;

first detection means for generating an electric signal corresponding to said alternating current voltage applied to said load;

analog-to-digital conversion means for converting the signal from said first detection means from analog to digital form;

second detection means for generating a synchronizing signal in synchronism with the wave of said alternating current power source; and electronic control means for alternately (1) sampling said digital form of the signal from said analog-to-digital conversion means during a first half cycle of the waveform, and in response to the sampling, calculating a square of said sampled digital form of the signal, (2) calculating the square-root of data resulting from calculating the square of said sampled digital form during a second half cycle of said waveform to derive a square root value, said electronic control means adding or subtracting the square root value to or from said preset control value to derive a control signal, said control signal being used to set a switching phase of said switching means, said switching means being controlled in timed relationship with said switching phase and the synchronizing signal from said second detection means.

9. An alternating current load power controller according to claim 8, wherein said electronic control means starts the process of sampling the signal from said first detection means in synchronism with the time point when said load starts to be energized.

* * * * *